US012391426B2

(12) United States Patent
Binshtok et al.

(10) Patent No.: US 12,391,426 B2
(45) Date of Patent: Aug. 19, 2025

(54) REINFORCED PAPERBOARD TRAY, METHOD FOR MANUFACTURING A REINFORCED PAPERBOARD TRAY, AND METHOD FOR USING A PAPERBOARD TRAY

(71) Applicant: WestRock MWV, LLC, Atlanta, GA (US)

(72) Inventors: Ronald J. Binshtok, Quinton, VA (US); William Statelman, Richmond, VA (US); Trisha J. Massenzo, Richmond, VA (US)

(73) Assignee: WestRock MWV, LLC, Atlanta, GA (US)

( * ) Notice: Subject to any disclaimer, the term of this patent is extended or adjusted under 35 U.S.C. 154(b) by 342 days.

(21) Appl. No.: 17/104,195

(22) Filed: Nov. 25, 2020

(65) Prior Publication Data

US 2021/0155368 A1 May 27, 2021

Related U.S. Application Data

(60) Provisional application No. 62/940,506, filed on Nov. 26, 2019.

(51) Int. Cl.
*B65D 5/44* (2006.01)
*B65D 5/20* (2006.01)
(Continued)

(52) U.S. Cl.
CPC ..... *B65D 5/445* (2013.01); *B65D 5/20* (2013.01); *B65D 5/563* (2013.01); *B65D 5/62* (2013.01)

(58) Field of Classification Search
CPC ..... B65D 5/443; B65D 5/445; B65D 5/2019; B65D 5/2038; B65D 5/2047; B65D 5/243;
(Continued)

(56) References Cited

U.S. PATENT DOCUMENTS 1,927,482 A 9/1933 Allen et al.
2,157,407 A 5/1939 Frost
(Continued)

FOREIGN PATENT DOCUMENTS

DE 19802051 A1 * 7/1999 ..... B65D 5/2047
EP 1 280 707 2/2003
(Continued)

OTHER PUBLICATIONS

International Searching Authority: International Search Report and Written Opinion, Intl. App. No. PCT/US2020/062155 (Feb. 19, 2021).

*Primary Examiner* — Nathan J Newhouse
*Assistant Examiner* — Phillip D Schmidt
(74) *Attorney, Agent, or Firm* — Neil G. Cohen; Rohini K. Garg

(57) ABSTRACT

A reinforced paperboard tray includes a coated paperboard in the form of a bottom wall, a side wall extending upwardly around the bottom wall, and a curved flange extending outwardly around the side wall. The coated paperboard includes a single-ply paperboard substrate having a first major side and a second major side, the first major side corresponding to an upper side of the bottom wall, and a barrier coating on the first major side of the single-ply paperboard substrate. A paperboard reinforcement is attached to the curved flange.

21 Claims, 36 Drawing Sheets

(51) Int. Cl.
*B65D 5/56* (2006.01)
*B65D 5/62* (2006.01)

(58) Field of Classification Search
CPC ..... B65D 5/246; B65D 5/248; B65D 1/34; A47G 19/03
USPC ..... 229/407, 125.35, 406, 169, 171, 176; 220/645
See application file for complete search history.

(56) References Cited

U.S. PATENT DOCUMENTS

| | | | | |
|---|---|---|---|---|
| 2,260,651 | A | 10/1941 | Annen | |
| 3,316,102 | A * | 4/1967 | Doll | B65D 77/2024 229/116 |
| 4,114,797 | A * | 9/1978 | Manizza | B65D 5/247 229/188 |
| 4,304,352 | A * | 12/1981 | Humphries | B65D 5/2047 229/125.35 |
| 5,862,977 | A * | 1/1999 | Hirano | B65D 1/28 229/5.5 |
| 6,715,630 | B2 | 4/2004 | Littlejohn et al. | |
| 6,857,561 | B2 | 2/2005 | Williams et al. | |
| 7,048,176 | B2 | 5/2006 | Littlejohn et al. | |
| 7,757,885 | B2 | 7/2010 | Goeking et al. | |
| 8,534,460 | B2 | 9/2013 | Wnek et al. | |
| 8,684,260 | B2 | 4/2014 | White et al. | |
| 8,741,443 | B2 | 6/2014 | Hilbish | |
| 9,315,292 | B2 | 4/2016 | Wnek et al. | |
| 9,539,786 | B2 | 1/2017 | Marshall | |
| 9,655,461 | B2 | 5/2017 | Littlejohn | |
| D793,817 | S * | 8/2017 | Chen | D7/602 |
| 9,725,210 | B2 | 8/2017 | Wnek et al. | |
| 9,771,206 | B2 | 9/2017 | Marshall | |
| 9,926,098 | B2 | 3/2018 | Fike | |
| 10,023,348 | B2 | 7/2018 | D'amato | |
| 10,077,134 | B2 | 9/2018 | Wnek et al. | |
| 10,232,973 | B2 | 3/2019 | Burke | |
| 10,294,008 | B2 | 5/2019 | Marshall | |
| 10,336,500 | B2 | 7/2019 | Burke | |
| 10,647,467 | B1 * | 5/2020 | Tibbets | B31F 1/0038 |
| 2003/0183681 | A1 | 10/2003 | Liou | |
| 2003/0226881 | A1 | 12/2003 | Liou | |
| 2006/0006215 | A1 * | 1/2006 | Chen | B65D 5/563 229/109 |
| 2006/0213962 | A1 * | 9/2006 | Anghileri | B65D 5/2019 229/125.35 |
| 2008/0156857 | A1 | 7/2008 | Johnston | |
| 2014/0374472 | A1 | 12/2014 | Treccani et al. | |
| 2016/0376054 | A1 | 12/2016 | Patchen et al. | |
| 2017/0217654 | A1 | 8/2017 | Harmon | |
| 2018/0030658 | A1 | 2/2018 | Chung et al. | |
| 2019/0009970 | A1 | 1/2019 | Yang | |

FOREIGN PATENT DOCUMENTS

| | | | | |
|---|---|---|---|---|
| EP | 2 305 569 | | 4/2011 | |
| EP | 2338800 | A1 * | 6/2011 | B65D 1/46 |
| EP | 2 573 008 | | 3/2013 | |
| EP | 2965997 | A1 * | 1/2016 | B29C 51/16 |
| JP | H06-48474 | | 7/1994 | |
| JP | 2000-141511 | | 5/2000 | |
| JP | 2001-301737 | | 10/2001 | |

* cited by examiner

REINFORCED PAPERBOARD TRAY, METHOD FOR MANUFACTURING A REINFORCED PAPERBOARD TRAY, AND METHOD FOR USING A PAPERBOARD TRAY

PRIORITY

This application claims priority from U.S. Ser. No. 62/940,506 filed on Nov. 26, 2019, the entire contents of which are incorporated herein by reference.

FIELD

The present application relates to the field of trays suitable for food packaging, particularly trays suitable for overwrapping of moist food products into a case-ready package for shelf storage.

BACKGROUND

Various trays are known in the art for carrying moist food products, such as meat, poultry, seafood, and produce. It is desirable that such trays are water- and grease-resistant to effectively carry and store the food products.

Such trays may be overwrapped with a transparent wrapping material in order to display the food products carried by the tray and placed on display in retail markets. Thus, it is desirable that such trays handle the overwrapping process without failing.

Suitable trays include conventional trays formed from expanded polystyrene. However, there is a growing trend to limit the use of expanded polystyrene trays.

Accordingly, those skilled in the art continue with research and development in the field of trays suitable for food packaging.

SUMMARY

In one embodiment, a reinforced paperboard tray includes a coated paperboard in the form of a bottom wall, a side wall extending upwardly around the bottom wall, and a curved flange extending outwardly around the side wall. The coated paperboard includes a single-ply paperboard substrate having a first major side and a second major side. The first major side corresponds to an upper side of the bottom wall. A barrier coating is disposed on the first major side of the single-ply paperboard substrate. A paperboard reinforcement is attached to the curved flange.

In another embodiment, a method for using a reinforced paperboard tray includes positioning a food product within a reinforced paperboard tray and wrapping a film over the product and the reinforced paperboard tray. The reinforced paperboard tray includes a coated paperboard in the form of a bottom wall, a side wall extending upwardly around the bottom wall, and a curved flange extending outwardly around the side wall. The coated paperboard includes a single-ply paperboard substrate having a first major side and a second major side, the first major side corresponding to an upper side of the bottom wall, and a barrier coating on the first major side of the single-ply paperboard substrate. A paperboard reinforcement is attached to the curved flange.

Other embodiments of the disclosed reinforced paperboard tray and method for using a reinforced paperboard tray will become apparent from the following detailed description, the accompanying drawings, and the appended claims.

DETAILED DESCRIPTION

By positioning a high stiffness barrier coating on a side of a single-ply paperboard substrate that corresponds to an inner side of a paperboard tray formed from the single-ply coated paperboard, the paperboard tray can be provided with water- and grease-resistance desirable for carrying moist food items, and the paperboard tray can be provided with sufficient rigidity to withstand conveying the paperboard tray through belts, holding the paperboard tray at a fixed point, and using the paperboard tray in an overwrapping process. In an aspect, the present description enables providing a coated paperboard and paperboard tray that are compostable. In another aspect, the present description enables providing a coated paperboard and paperboard tray that are recyclable. In yet another aspect, the present description enables providing a coated paperboard and paperboard tray that are printable or capable of being dyed.

Figure 1:
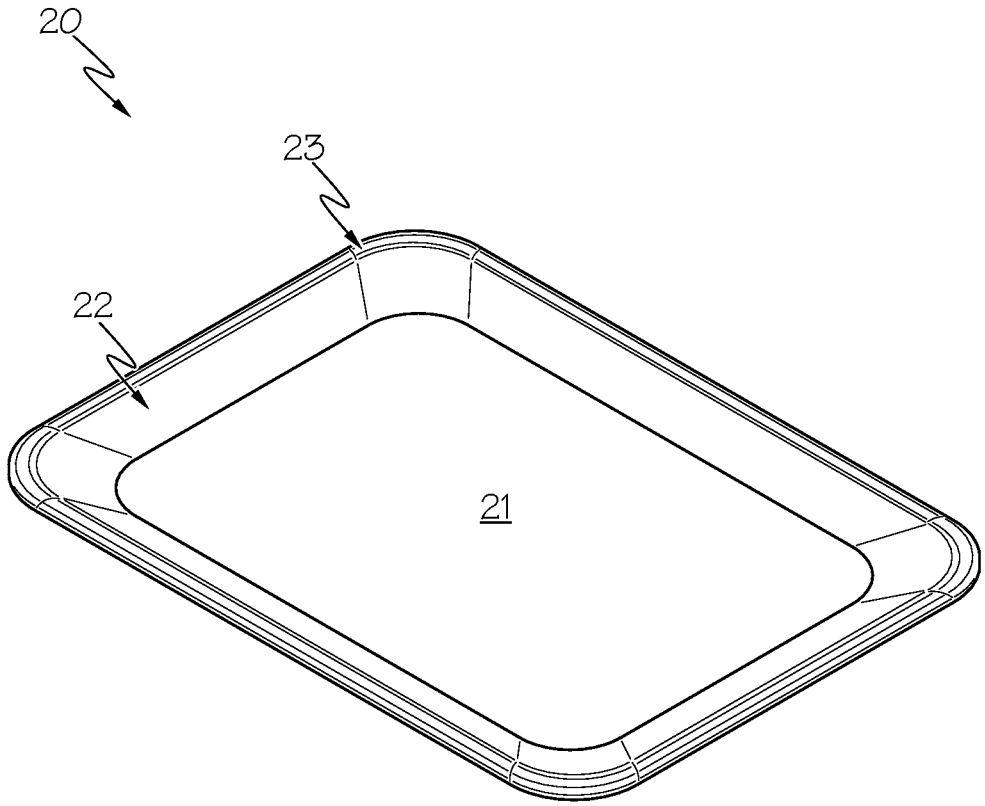
FIG. 1 is a perspective view of an exemplary paperboard tray according to the present description.
Figure 2:
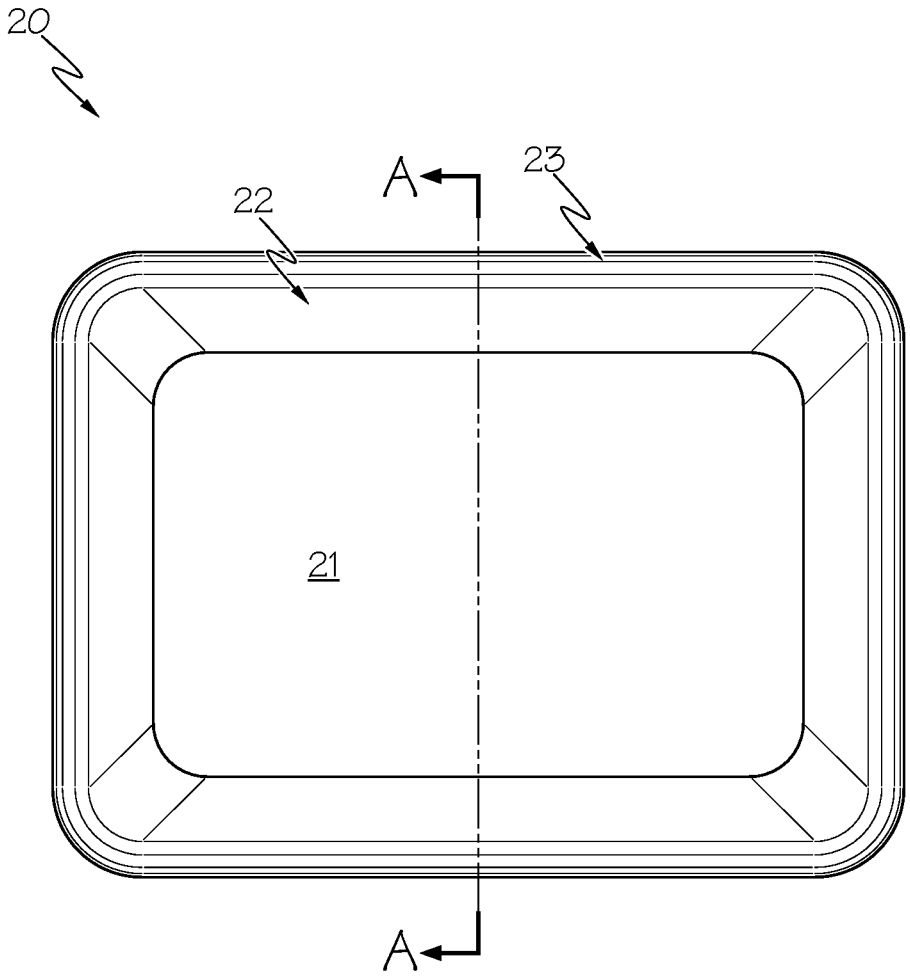
FIG. 2 is a bottom view of the paperboard tray of FIG. 1.
Figure 3:
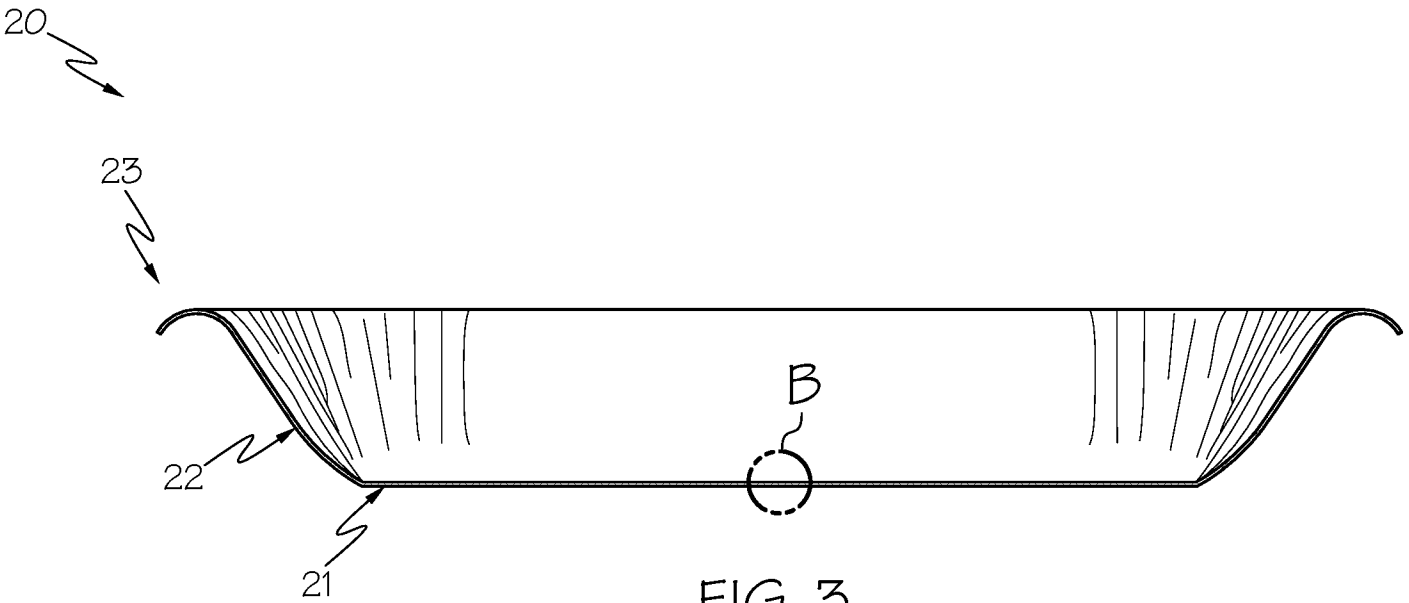
FIG. 3 is a side sectional view of the paperboard tray of FIG. 2 along section A-A.
Figure 4:
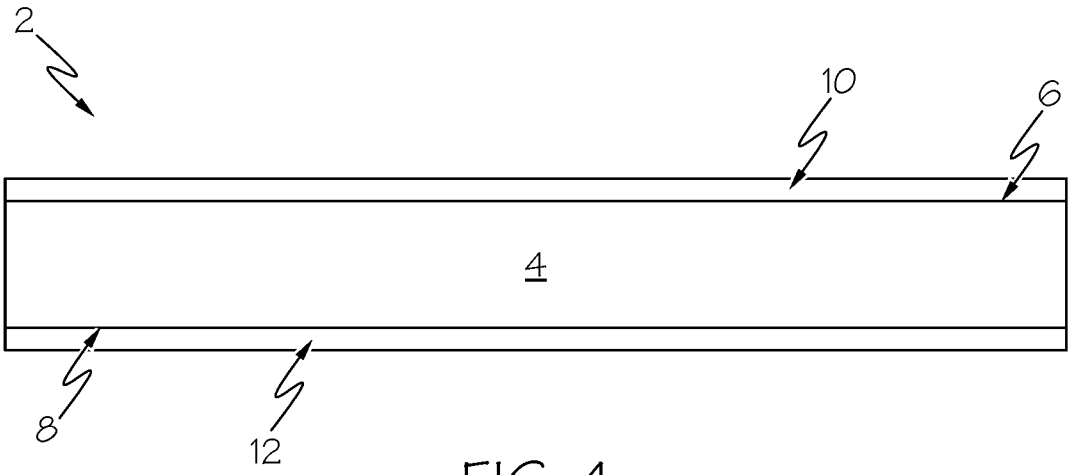
FIG. 4 is a cross-section of the paperboard tray within circle B of FIG. 3.

FIG. 1 is a perspective view of a paperboard tray 20. FIG. 2 is a bottom view of the paperboard tray 20 of FIG. 1. FIG. 3 is a side sectional view of the paperboard tray of FIG. 2 along section A-A. FIG. 4 is a cross-section of the paperboard tray within circle B of FIG. 3.

Although the paperboard tray 20 is illustrated as having a rectangular shape, the shape is not limited to rectangular and may include any shape, such as circular, square, polygon, or irregular. In a specific expression, the paperboard tray 20 may be rectangular. In an aspect, the length may be between 8 and 10 inches, the width may be between 6 and 7 inches, and the height may be between 0.75 and 2 inches. In a specific expression, the length, width, and height may be approximately 8.75 inches, 6.5 inches, and 1.25 inches, respectively. However, it will be understood that the present description is not limited to these specific dimensions and other dimensions and shapes are possible and would be desirable.

As shown in FIGS. 1-3, the paperboard tray 20 includes a coated paperboard 2 (FIG. 4) in the form of a bottom wall 21, a side wall 22 extending upwardly around the bottom wall 21, and a flange 23 extending outwardly around the side wall 22.

As shown in FIG. 4, the coated paperboard 2 for the paperboard tray 20 includes a single-ply paperboard substrate 4 having a first major side 6 and a second major side 8 and a barrier coating 10 on the first major side 6 of the single-ply paperboard substrate 4. The first major side 6 of the paperboard substrate 4 corresponds to an upper side of the bottom wall 21 of the paperboard tray 20. The barrier coating 10 may be, for example, a single coating layer positioned directly on the first major side 6 of the single-ply paperboard substrate 4. The barrier coating 10 may define a first outermost surface of the coated paperboard 2 and the second major side 8 of the single-ply paperboard substrate 4 may define a second outermost surface of the coated paperboard 2. Alternatively, as shown, the coated paperboard 2 may further include a topcoat 12 on the second major side 8, and the topcoat 12 may define the second outermost surface of the coated paperboard 2. The topcoat 12, may be printable, or capable of being dyed, such as to permit display of graphics and/or text on the paperboard tray 20.

In an aspect, the coated paperboard 2 for the paperboard tray 20 may have an average caliper thickness of 0.010 inch or greater. In another aspect, the coated paperboard 2 may have an average caliper thickness in the range of 0.010 inch to 0.035 inch. In yet another aspect, the coated paperboard 2 may have an average caliper thickness in the range of 0.016 inch to 0.026 inch.

The single-ply paperboard substrate 4 for the paperboard tray 20 may include any cellulosic material that is capable of being coated with the barrier coating layer. The single-ply paperboard substrate 4 may be bleached or unbleached. Appropriate single-ply paperboard substrates 4 include corrugating medium, linerboard, solid bleached sulfate (SBS), folding boxboard (FBB), and coated unbleached kraft (CUK). In a specific expression, the single-ply paperboard substrate 4 may be solid bleached sulfate.

In an aspect, the single-ply paperboard substrate 4 for the paperboard tray 20 may have an average caliper thickness of 0.010 inch or greater. In another aspect, the single-ply paperboard substrate 4 may have an average caliper thickness in the range of 0.010 inch to 0.035 inch. In yet another aspect, the single-ply paperboard substrate 4 may have an average caliper thickness in the range of 0.016 inch to 0.024 inch (16 point to 24 point). In yet another aspect, the single-ply paperboard substrate 4 may have an average caliper thickness in the range of 0.016 inch to 0.022 inch (16 point to 22 point). In yet another aspect, the single-ply paperboard substrate 4 may have an average caliper thickness in the range of 0.016 inch to 0.020 inch (16 point to 20 point). In a specific expression, the single-ply paperboard substrate 4 may have an average caliper thickness of 0.018 inch (18 point). A high caliper of the single-ply paperboard substrate 4 may function to increase rigidity of the coated paperboard 2 (FIG. 4) when formed into a paperboard tray to withstand conveying the paperboard tray through belts, holding the paperboard tray at a fixed point, and a process of overwrapping the paperboard tray.

In an aspect, the single-ply paperboard substrate 4 for the paperboard tray 20 may have an uncoated basis weight of at least about 60 pounds per 3000 $ft^2$. In one expression the single-ply paperboard substrate 4 may have an uncoated basis weight ranging from about 60 pounds per 3000 $ft^2$ to about 400 pounds per 3000 $ft^2$. In another expression the single-ply paperboard substrate 4 may have an uncoated basis weight ranging from about 120 pounds per 3000 $ft^2$ to about 250 pounds per 3000 $ft^2$. In another expression the single-ply paperboard substrate 4 may have an uncoated basis weight ranging from about 150 pounds per 3000 $ft^2$ to about 210 pounds per 3000 $ft^2$. In a specific expression the single-ply paperboard substrate 4 may have an uncoated basis weight of about 185 pounds per 3000 $ft^2$.

In an aspect, the single-ply paperboard substrate 4 for the paperboard tray 20 may have an internal sizing agent incorporated therein. The internal sizing agent may be any chemical or chemicals added, before thermoforming, which exhibit hydrophobicity. The internal sizing agent may be added before the papermaking process, during the papermaking process, after the papermaking process, or combinations thereof. In an example, the internal sizing agent may be added after the papermaking process via a liquid additive system, such as a continuous metering system from CMS Industrial Technologies, LLC, Gainesville, Georgia, United States.

The internal sizing for the paperboard tray 20 agent may include, for example, alkyl ketene dimer (AKD), dispersed rosin size (DRS), alkyl succinic anhydride (ASA), and combinations thereon. In a specific expression, the internal sizing agent may include 8 to 12 pounds of DRS per ton of paperboard and 1 pound of AKD per ton of paperboard.

When the coated paperboard 2 (FIG. 4) is formed into a paperboard tray 20, the barrier coating 10 functions to separate a moist food product carried on the paperboard tray from the single-ply paperboard substrate 4. Thus, the barrier coating 10 is a coating having water- and grease-resistance.

The barrier coating 10 for the paperboard tray 20 may optionally be a high stiffness barrier coating having an elastic modulus of 1.5 GPa or greater. By positioning the high stiffness barrier coating 10 on the upper side of the bottom wall 21, the paperboard tray 20 is provided with water- and grease-resistance desirable for carrying moist food items, and the paperboard tray 20 is provided with increased rigidity to withstand conveying the paperboard tray 20 through belts, holding the paperboard tray 20 at a fixed point, and using the paperboard tray 20 in an overwrapping process. In an aspect, the barrier coating 10 may have an elastic modulus of from 1.5 GPa to 6.0 GPa. In another aspect, the barrier coating 10 may have an elastic modulus of from 2.0 GPa to 5.0 GPa.

In an aspect, the barrier coating 10 for the paperboard tray 20 may include polylactic acid (PLA). For example, the barrier coating 10 can be (or can include) one or more of the biopolymer coatings disclosed in Intl. Pat. App. No. PCT/US2016/062136 filed on Nov. 16, 2016, the entire contents of which are incorporated herein by reference. In another aspect, the barrier coating 10 includes polyethylene terephthalate (PET).

In an aspect, the barrier coating 10 for the paperboard tray 20 may have an average thickness of 0.00025 inch or more. In another aspect, the barrier coating 10 may have an average thickness of 0.00025 to 0.005 inches. In yet another aspect, the barrier coating 10 may have an average thickness of 0.0005 to 0.003 inches. In yet another aspect, the barrier coating 10 may have an average thickness of 0.00075 to 0.002 inches. In yet another aspect, the barrier coating 10 may have an average thickness of 0.001 to 0.00175 inches. In yet another aspect, the barrier coating 10 may have an average thickness of 0.001 to 0.0015 inches. In yet another aspect, the barrier coating 10 may have an average thickness of 0.001 to 0.00125 inches.

The barrier coating 10 for the paperboard tray 20 may be applied, for example, by extrusion coating onto the single-ply paperboard substrate.

According to the present description, the flange 23 may include or may be a curved flange. The flange 23 may include or may be curved around the entire periphery of the paperboard tray 20 as shown in FIG. 3, or the flange 23 may include or may be curved around less than the entire periphery of the paperboard tray 20. In an example, the flange 23 may include or may be curved at one or both longitudinal sides of the paperboard tray 20 and the flange 23 may include or may be horizontal at one or both latitudinal sides of the paperboard tray 20. In another example, the flange 23 may include or may be curved at one or both latitudinal sides of the paperboard tray 20 and the flange 23 may include or may be horizontal at one or both longitudinal sides of the paperboard tray 20.

Also, as shown in FIG. 3, the flange 23 may be entirely curved with respect to a cross-section thereof as shown in FIG. 3. Alternatively, the flange 23 may be partly curved with respect to a cross-section thereof, or the flange 23 may be mostly curved with respect to a cross-section thereof. In FIG. 3, the flange 23 is entirely curved with respect to a cross-section thereof around the entire periphery of the paperboard tray 20. In an alternatively, the flange 23 may be entirely curved with respect to a cross-section thereof around part of the periphery of the paperboard tray 20 while the flange 23 may be partly curved or mostly curved around another part of the periphery of the paperboard tray 20.

The curvature of the flange 23 is beneficial for providing the paperboard tray 20 with sufficient characteristics to withstand conveying the paperboard tray 20 through belts, holding the paperboard tray 20 at a fixed point, and using the paperboard tray 20 in an overwrapping process.

The paperboard tray 20 may be formed by any manufacturing method, such as by a thermoforming method.

According to an aspect of the present description, a method for manufacturing the paperboard tray 20 includes forming a paperboard blank from a coated paperboard 2, in which the coated paperboard 2 (FIG. 4) includes the single-ply paperboard substrate 4 having the first major side 6 and the second major side 8 and the barrier coating 10 on the first major side of the single-ply paperboard substrate 4. The method further includes thermoforming the paperboard blank into the paperboard tray 20 having the bottom wall 21, the side wall 22 extending upwardly around the bottom wall 21, and the flange 23 including the curvature as described above.

The paperboard blank may be formed from a roll of coated paperboard 2 (FIG. 4). For example, a roll of coated paperboard 2 may be fed to a forming press. The roll may be unwound at the forming press and directed to a cutting section of the forming press where the coated paperboard 2 is cut to the shape of the paperboard blank.

The paperboard blank may then be transported to a thermoforming section of the same (or different) forming press. The thermoforming section may include a male die and a female die used for thermoforming the paperboard blank into a paperboard tray 20.

At the thermoforming section, the paperboard blank is thermoformed with the male die and the female die using heat and pressure to form the paperboard tray 20. Thus, the paperboard blank may be heated, drawn into the temperature-controlled female die by the temperature-controlled male die, and then held against the surfaces of the male die and female die until cooled.

According to the present description, the paperboard tray 20 may further include a paperboard reinforcement 30 attached to the flange 23. The paperboard reinforcement 30 reinforces the flange 23 to provide the flange 23 of the paperboard tray 20 with sufficient characteristics to withstand conveying the paperboard tray 20 through belts, holding the paperboard tray 20 at a fixed point, and using the paperboard tray 20 in an overwrapping process. Particularly, the paperboard reinforcement 30 increases strength of the flange to prevent buckling or kinking often due to stress while overwrapping or during distribution. The strength is increased by the combination of the additional paperboard and the additional coating of the integral paperboard flange.

Figure 5:
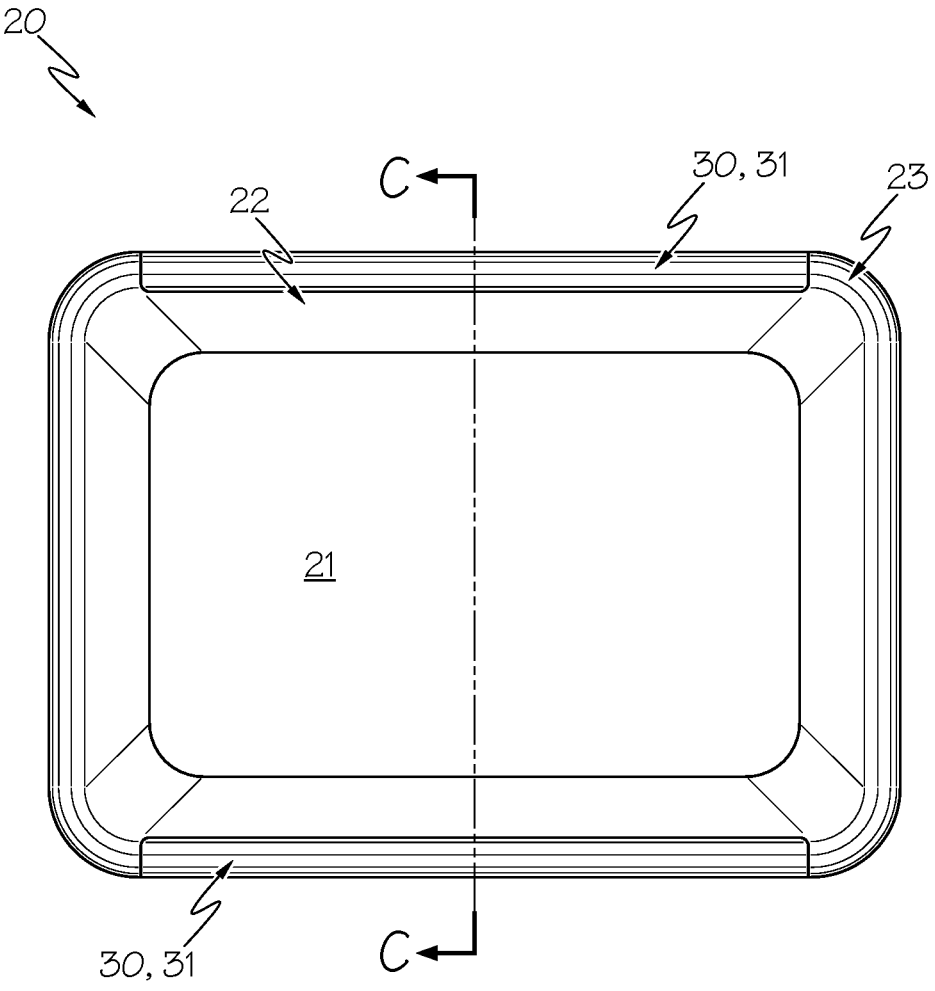
FIG. 5 is a bottom view of an exemplary paperboard tray of FIG. 1, including a paperboard reinforcement, according to one aspect of the present description.
Figure 6:
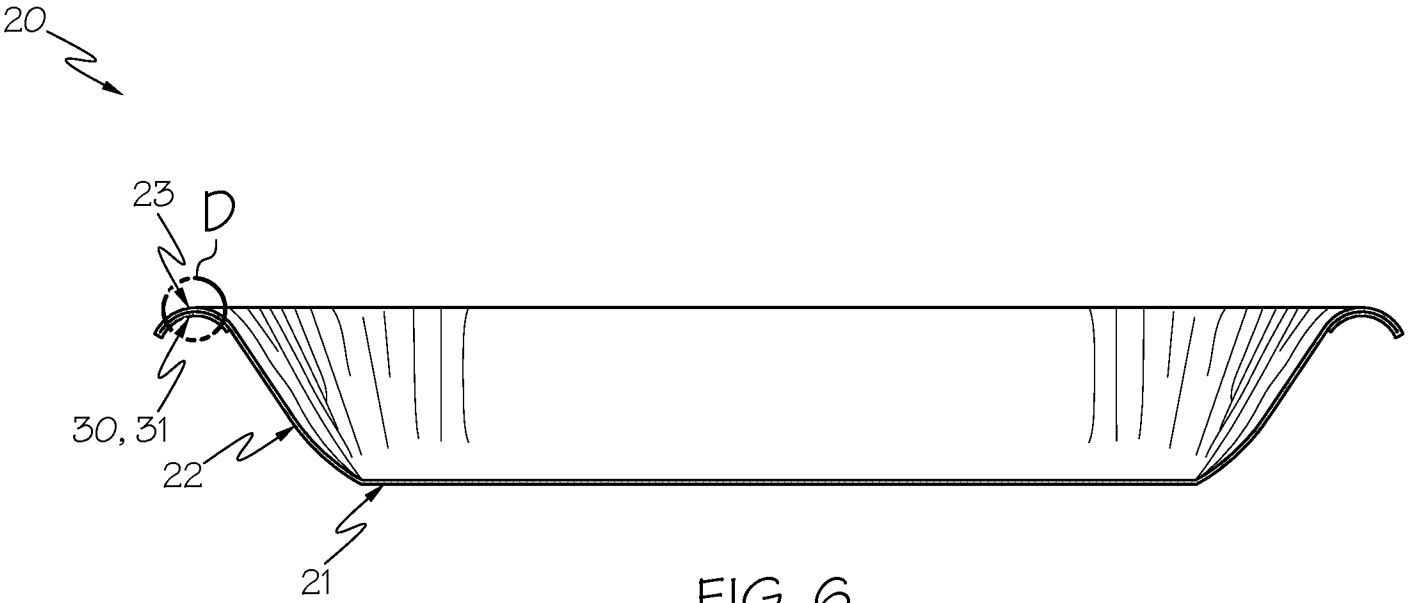
FIG. 6 is a side sectional view of the paperboard tray of FIG. 5 along section C-C.

In an aspect, the coated paperboard 2 (FIG. 4) that is formed into the form of the bottom wall 21, the side wall 22, and the flange 23 of the paperboard tray 20 may further include the form of the paperboard reinforcement 30. Thus, the bottom wall 21, the side wall 22, the flange 23, and the paperboard reinforcement 30 may be formed from the same unitary piece of coated paperboard 2, such as shown in FIGS. 5 and 6. The coated paperboard 2 for the paperboard tray 20 may be formed, such as by thermoforming as described above, into the form of the bottom wall 21, the side wall 22, the flange 23, and a paperboard reinforcement 30 attached to the flange 23.

In another aspect, the paperboard reinforcement 30 may be separate from the coated paperboard 2 that is formed into the form of the bottom wall 21, the side wall 22, and the flange 23 of the paperboard tray 20. Thus, the bottom wall 21, the side wall 22, and the flange 23 may be formed from the same unitary piece of coated paperboard 2, and the paperboard reinforcement 30 may be a separate piece of paperboard. In this case, the coated paperboard 2 for the paperboard reinforcement 30 may have the same composition as the coated paperboard 2 for the paperboard tray 20 or may have a different composition as the coated paperboard 2 for the paperboard tray 20.

Thus, in an aspect, the paperboard reinforcement 30 may be a coated paperboard 2 that is the same composition as or different composition from the coated paperboard 2 that forms the bottom wall 21, the side wall 22, and the flange 23 of the paperboard tray 20.

In an aspect, the coated paperboard 2 for the paperboard reinforcement 30 may include a single-ply paperboard substrate 4 having a first major side 6 and a second major side 8 and a barrier coating 10 on the first major side 6 of the single-ply paperboard substrate 4. The barrier coating 10 may be, for example, a single coating layer positioned directly on the first major side 6 of the single-ply paperboard substrate 4. The barrier coating 10 may define a first outermost surface of the coated paperboard 2 and the second major side 8 of the single-ply paperboard substrate 4 may define a second outermost surface of the coated paperboard 2. Alternatively, as shown, the coated paperboard 2 may further include a topcoat 12 on the second major side 8, and the topcoat 12 may define the second outermost surface of the coated paperboard 2.

In an aspect, the coated paperboard 2 for the paperboard reinforcement 30 may have an average caliper thickness of 0.010 inch or greater. In another aspect, the coated paperboard 2 may have an average caliper thickness in the range of 0.010 inch to 0.035 inch. In yet another aspect, the coated paperboard 2 may have an average caliper thickness in the range of 0.016 inch to 0.026 inch.

The single-ply paperboard substrate 4 for the paperboard reinforcement 30 may include any cellulosic material that is capable of being coated with the barrier coating layer. The single-ply paperboard substrate 4 may be bleached or unbleached. Appropriate single-ply paperboard substrates 4 include corrugating medium, linerboard, solid bleached sulfate (SBS), folding boxboard (FBB), and coated unbleached kraft (CUK). In a specific expression, the single-ply paperboard substrate 4 may be solid bleached sulfate.

In an aspect, the single-ply paperboard substrate 4 for the paperboard reinforcement 30 may have an average caliper thickness of 0.010 inch or greater. In another aspect, the single-ply paperboard substrate 4 may have an average caliper thickness in the range of 0.010 inch to 0.035 inch. In yet another aspect, the single-ply paperboard substrate 4 may have an average caliper thickness in the range of 0.016 inch to 0.024 inch (16 point to 24 point). In yet another aspect, the single-ply paperboard substrate 4 may have an average caliper thickness in the range of 0.016 inch to 0.022 inch (16 point to 22 point). In yet another aspect, the single-ply paperboard substrate 4 may have an average caliper thickness in the range of 0.016 inch to 0.020 inch (16 point to 20 point). In a specific expression, the single-ply paperboard substrate 4 may have an average caliper thickness of 0.018 inch (18 point). A high caliper of the single-ply paperboard substrate 4 for the paperboard reinforcement 30 may function to increase rigidity of the flange 23 of the paperboard tray to withstand conveying the paperboard tray 20 through belts, holding the paperboard tray 20 at a fixed point, and a process of overwrapping the paperboard tray.

In an aspect, the single-ply paperboard substrate 4 for the paperboard reinforcement 30 may have an uncoated basis weight of at least about 60 pounds per 3000 $ft^2$. In one expression the single-ply paperboard substrate 4 may have an uncoated basis weight ranging from about 60 pounds per 3000 $ft^2$ to about 400 pounds per 3000 $ft^2$. In another expression the single-ply paperboard substrate 4 may have an uncoated basis weight ranging from about 120 pounds per 3000 $ft^2$ to about 250 pounds per 3000 $ft^2$. In another expression the single-ply paperboard substrate 4 may have an uncoated basis weight ranging from about 150 pounds per 3000 $ft^2$ to about 210 pounds per 3000 $ft^2$. In a specific expression the single-ply paperboard substrate 4 may have an uncoated basis weight of about 185 pounds per 3000 $ft^2$.

In an aspect, the single-ply paperboard substrate 4 for the paperboard reinforcement 30 may have an internal sizing agent incorporated therein. The internal sizing agent may be any chemical or chemicals added, before thermoforming, which exhibit hydrophobicity. The internal sizing agent may be added before the papermaking process, during the papermaking process, after the papermaking process, or combinations thereof. In an example, the internal sizing agent may be added after the papermaking process via a liquid additive system, such as a continuous metering system from CMS Industrial Technologies, LLC, Gainesville, Georgia, United States.

The internal sizing agent for the paperboard reinforcement 30 may include, for example, alkyl ketene dimer (AKD), dispersed rosin size (DRS), alkyl succinic anhydride (ASA), and combinations thereon. In a specific expression, the internal sizing agent may include 8 to 12 pounds of DRS per ton of paperboard and 1 pound of AKD per ton of paperboard.

The barrier coating 10 for the paperboard reinforcement 30 may optionally be a high stiffness barrier coating having an elastic modulus of 1.5 GPa or greater. By positioning the high stiffness barrier coating 10 on the single-ply paperboard substrate 4 for the paperboard reinforcement 30, the paperboard tray 20 may be provided with increased rigidity to withstand using the paperboard tray 20 in an overwrapping process. In an aspect, the barrier coating 10 may have an elastic modulus of from 1.5 GPa to 6.0 GPa. In another aspect, the barrier coating 10 may have an elastic modulus of from 2.0 GPa to 5.0 GPa.

In an aspect, the barrier coating 10 for the paperboard reinforcement 30 may include polylactic acid (PLA). For example, the barrier coating 10 can be (or can include) one or more of the biopolymer coatings disclosed in Intl. Pat. App. No. PCT/US2016/062136 filed on Nov. 16, 2016, the entire contents of which are incorporated herein by reference. In another aspect, the barrier coating 10 includes polyethylene terephthalate (PET).

In an aspect, the barrier coating 10 for the paperboard reinforcement 30 may have an average thickness of 0.00025 inch or more. In another aspect, the barrier coating 10 may have an average thickness of 0.00025 to 0.005 inches. In yet another aspect, the barrier coating 10 may have an average thickness of 0.0005 to 0.003 inches. In yet another aspect, the barrier coating 10 may have an average thickness of 0.00075 to 0.002 inches. In yet another aspect, the barrier coating 10 may have an average thickness of 0.001 to 0.00175 inches. In yet another aspect, the barrier coating 10 may have an average thickness of 0.001 to 0.0015 inches. In yet another aspect, the barrier coating 10 may have an average thickness of 0.001 to 0.00125 inches.

The barrier coating 10 for the paperboard reinforcement 30 may be applied, for example, by extrusion coating onto the single-ply paperboard substrate 4 for the paperboard reinforcement 30.

In one or more aspects, the paperboard reinforcement 30 may be in the form of strips of paperboard to add an additional layer in locations requiring increased rigidity. The strips may be flat, curved, or spiral. The strips can be applied through gluing, adhesive or heat-activated coatings. Glue can further provide rigidity by tacking and providing an extra support. Application of the strips can occur either before, during or post thermoforming. Methods of production before thermoforming include, for example, gluing strips before die cutting and scoring. Additionally, strips can be fed into thermoforming tooling used for forming the overall shape of the paperboard tray and combined with flange through heat and pressure by heat-activating coatings. Finally, strips can be applied post thermoforming by, for example, gluing and attaching strips with or without pressure.

In another one or more aspects, the paperboard tray may have stiffening members lateral to the flange (stiffeners) structures that can fold over during or post thermoforming. The stiffeners may come as a result of extensions from the flange(s). The stiffeners can either be folded or rolled to the original distance of an arced flange. Folds or rolls can be held in place by the following: lug to lock it in place, crimper, welder, or glue. Glue can further provide rigidity by tacking and providing an extra support while stiffeners are folded over. Folds can be created and reinforced during thermoforming by a pre-step of folding and placing in the thermoforming tooling wherein it is reinforced to the inside portion of the flange by applying heat and pressure. Another method to create the fold as well as the roll would occur post-thermoforming. During thermoforming the stiffeners can extend outside the tooling to form the tray. After thermoforming the trays can stay in the tooling or be conveyed to a secondary step that folds or rolls the extensions to the underside of the flange(s). Folds/rolls can be held in place by an adhesive or glue as well as physical features such as slits that hold the stiffeners into place.

According to an embodiment of the present description, the paperboard reinforcement includes an integral paperboard reinforcement attached to a bottom surface of the flange, wherein the integral paperboard reinforcement is formed from the same coated paperboard that forms the bottom wall, the side wall, and the flange. Examples of the integral paperboard reinforcement 31 are shown in FIGS. 5-22 The integral paperboard reinforcement increases strength of the flange to prevent buckling or kinking often due to stress while overwrapping or during distribution. Also, the integral paperboard reinforcement redirects cut edges from areas of high purge/moisture concentration near the top of the tray to area of low purge/moisture concentration nearer to the bottom of the tray.

Figure 7:
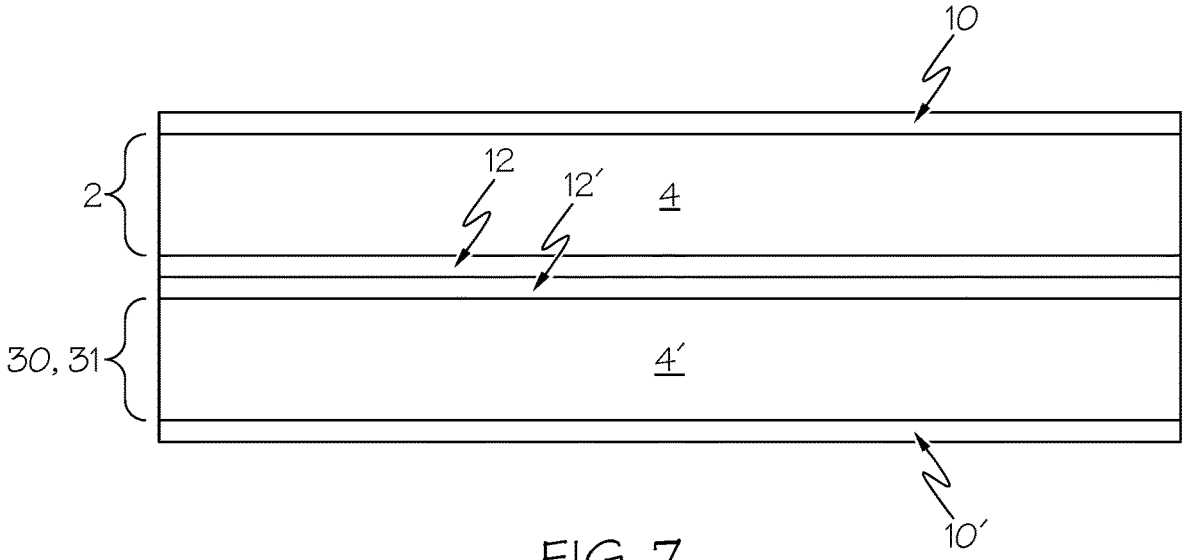
FIG. 7 is a cross-section of the paperboard tray within circle D of FIG. 6.

FIGS. 5-7 illustrate a first example of an integral paperboard reinforcement 31. As shown, a rectangular paperboard tray 20 includes a coated paperboard 2 (FIG. 4) in the form of a bottom wall 21, a side wall 22 extending upwardly around the bottom wall 21, a curved flange 23 extending outwardly around the side wall 22, and the integral paperboard reinforcement 31 at an end of the flange 23. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21. The integral paperboard reinforcement 31 is attached to the bottom surface of the curved flange 23. By attaching the integral paperboard reinforcement 31 to the bottom surface of the curved flange 23, the integral paperboard reinforcement 31 reinforces the flange 23 to provide the flange 23 of the paperboard tray 20 with improved characteristics to withstand conveying the paperboard tray 20 through belts, holding the paperboard tray 20 at a fixed point, and using the paperboard tray 20 in an overwrapping process. By reinforcing the flange 23 rather than the flange 23, the side wall 22, and the bottom wall 21, less material is required for the paperboard tray 20 and better flexibility of the paperboard tray 20 is facilitated. In a specific example, as shown in FIG. 5, the integral paperboard reinforcement 31 that is attached to the bottom surface of the curved flange 23 ends at the top of the side wall 22.

Figure 8:
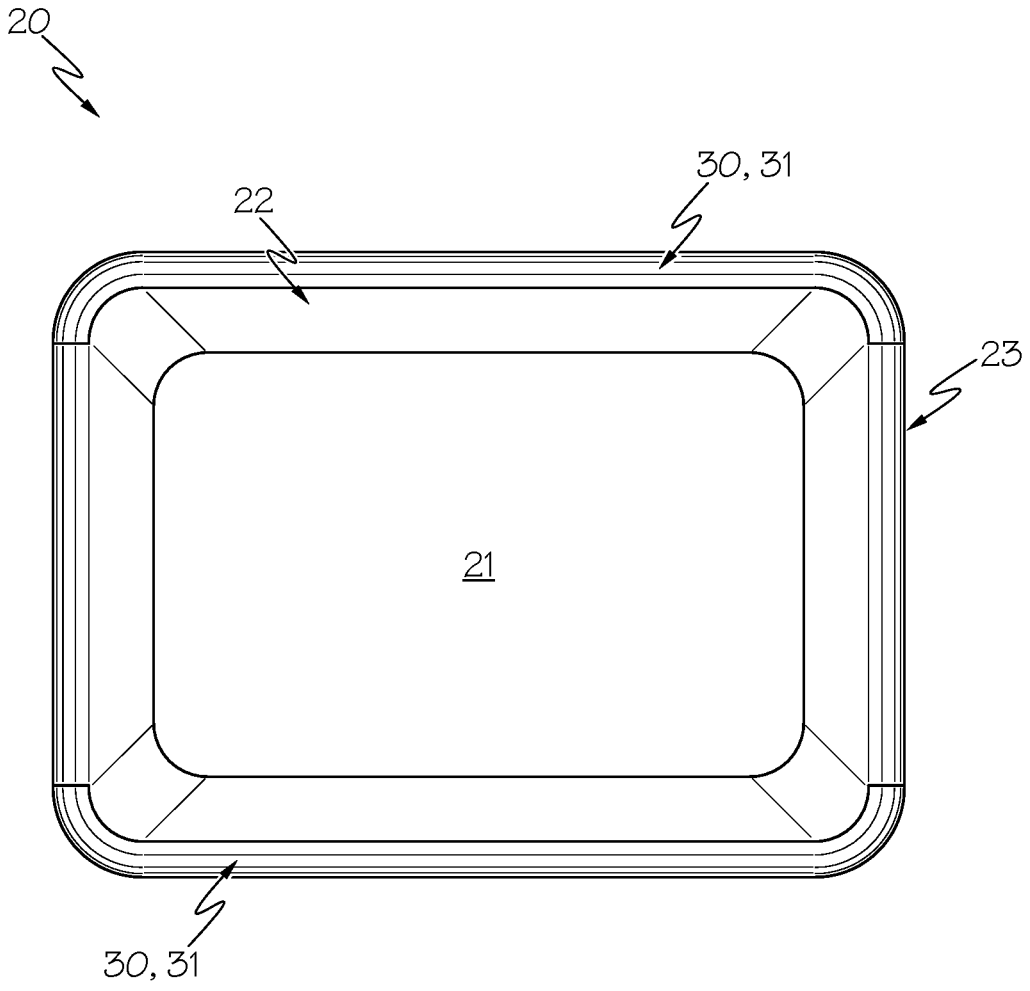
FIG. 8 is a bottom view of an exemplary paperboard tray of FIG. 1, including a paperboard reinforcement, according to another aspect of the present description.

In the example shown in FIGS. 5-7, integral paperboard reinforcement 31 is attached to the bottom surface of the flange 23 at both longitudinal ends of the rectangular paperboard tray 20. In an alternative, the integral paperboard reinforcement 31 may be attached to the bottom surface of the flange 23 at both latitudinal ends of the rectangular paperboard tray 20. In another alternative, the integral paperboard reinforcement 31 may be attached at the corners of the rectangular paperboard tray 20. In yet another alternative, the integral paperboard reinforcement 31 may be attached to the bottom surface of the flange 23 at both longitudinal ends and both latitudinal ends of the rectangular paperboard tray 20. In yet another alternative, the integral paperboard reinforcement 31 may be attached to the bottom surface of the flange 23 at either the longitudinal ends or both latitudinal ends of the rectangular paperboard tray 20 and the corners of the rectangular paperboard tray 20. In yet another alternative, the integral paperboard reinforcement 31 may be attached to the bottom surface of the flange 23 at both longitudinal ends, both latitudinal ends, and the corners of the rectangular paperboard tray 20. By way of example, FIG. 8 shows an exemplary paperboard tray 20 in which the integral paperboard reinforcement 31 is attached to the bottom surface of the flange 23 at the longitudinal ends of the rectangular paperboard tray 20 and the corners of the rectangular paperboard tray 20. Thus, the integral paperboard reinforcements 31 can stop short of the corners such as shown in FIG. 5 or the integral paperboard reinforcements can extend to the corners of the paperboard tray 20 such as shown in FIG. 8. Stopping the integral paperboard reinforcements 31 short of the corners requires less material for the paperboard tray 20 and ensures better flexibility of the paperboard tray 20. Stopping the integral paperboard reinforcements 31 short of the corners requires less material for the paperboard tray 20 and ensures better flexibility of the paperboard tray 20. Extending the integral paperboard reinforcements 31 to the corners of the paperboard tray 20 enhances strength of the flange 23 and also increases the overall strength of the paperboard tray 20. The integral paperboard reinforcements 31 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the integral paperboard reinforcements 31 to the corners of the paperboard tray 20 decreases the likelihood of buckling along the latitudinal or longitudinal ends and decreases the likelihood of bending in the corners which could torque the tray. Also, due to the integral nature of the integral paperboard reinforcement, the cut edges are redirected from areas of high purge/moisture concentration near the top of the tray to area of low purge/moisture concentration nearer to the bottom of the tray both at the straight edges of the latitudinal or longitudinal ends and at the corners of the paperboard tray. Other embodiments include that the paperboard tray 20 has a shape other than rectangular.

Figure 9:
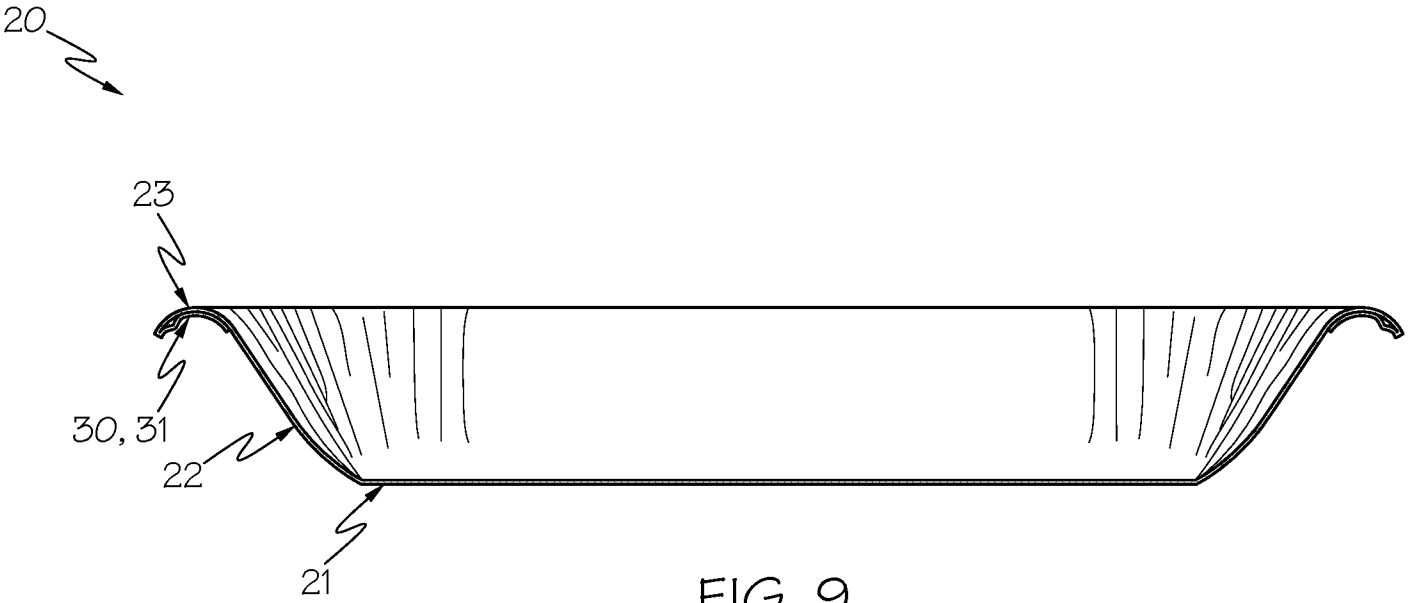
FIG. 9 is a side sectional view of the paperboard tray of FIG. 5 along section C-C according to a first variation.
Figure 10:
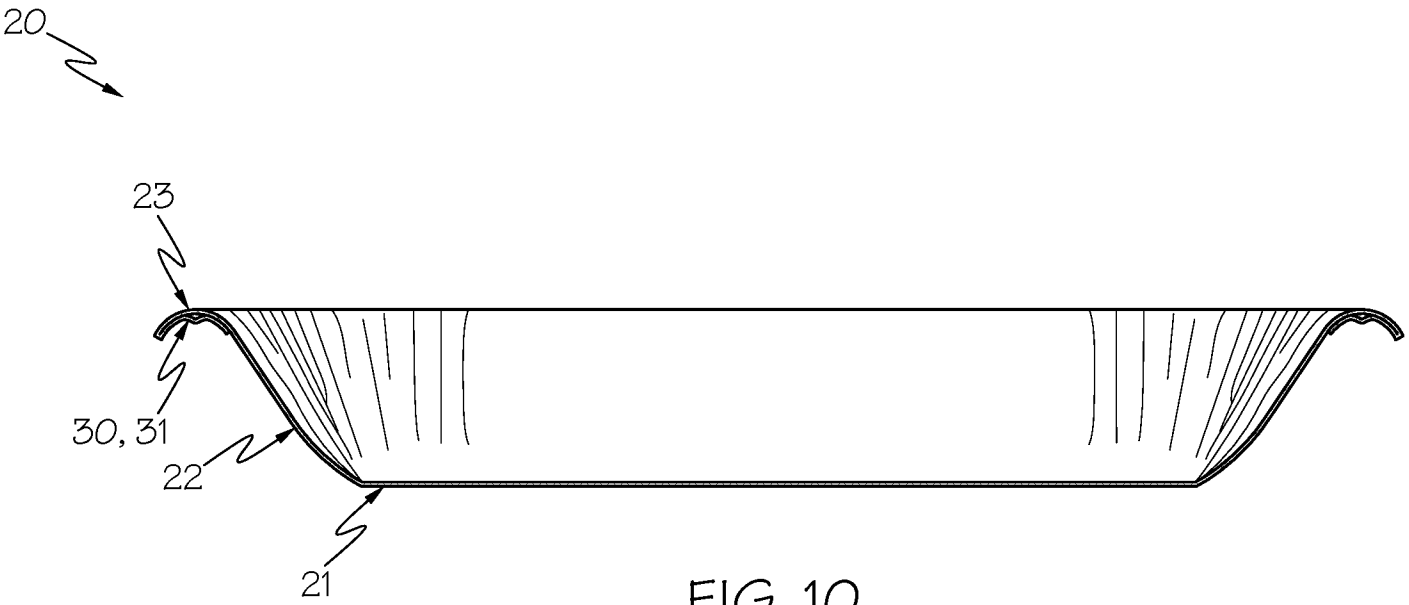
FIG. 10 is a side sectional view of the paperboard tray of FIG. 5 along section C-C according to a second variation.
Figure 11:
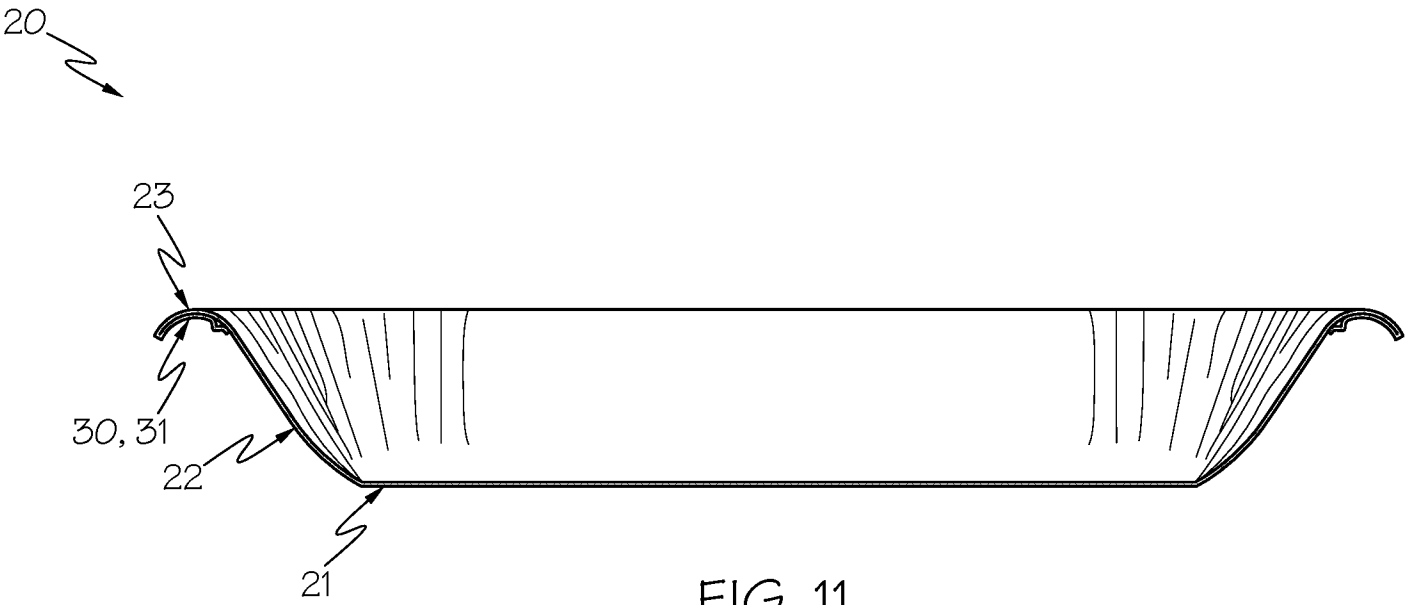
FIG. 11 is a side sectional view of the paperboard tray of FIG. 5 along section C-C. according to a third variation.

In the illustrated example as shown in FIG. 6, the shape of the integral paperboard reinforcement 31 at the bottom surface of the flange 23 matches the shape of the flange 23. Alternatively, the integral paperboard reinforcement 31 may have a different shape than the bottom surface of the flange 23 such there is an air gap between the integral paperboard reinforcement 31 and the bottom surface of the flange 23. The air gap facilitates for de-nesting of multiple paperboard trays stacked upon each other in a nesting relationship. The air gap may be positioned at any point between the integral paperboard reinforcement 31 and the bottom surface of the flange 23. FIGS. 9 to 11 shown three exemplary positions of an air gap between the integral paperboard reinforcement 31 and the bottom surface of the flange 23. In FIG. 9, the air gap is positioned between the integral paperboard reinforcement 31 and the bottom surface of the flange 23 at an end portion of the flange 23. In FIG. 10, the air gap is positioned between the integral paperboard reinforcement 31 and the bottom surface of the flange 23 at a middle portion of the flange 23. In FIG. 11, the air gap is positioned between the integral paperboard reinforcement 31 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

Figure 12:
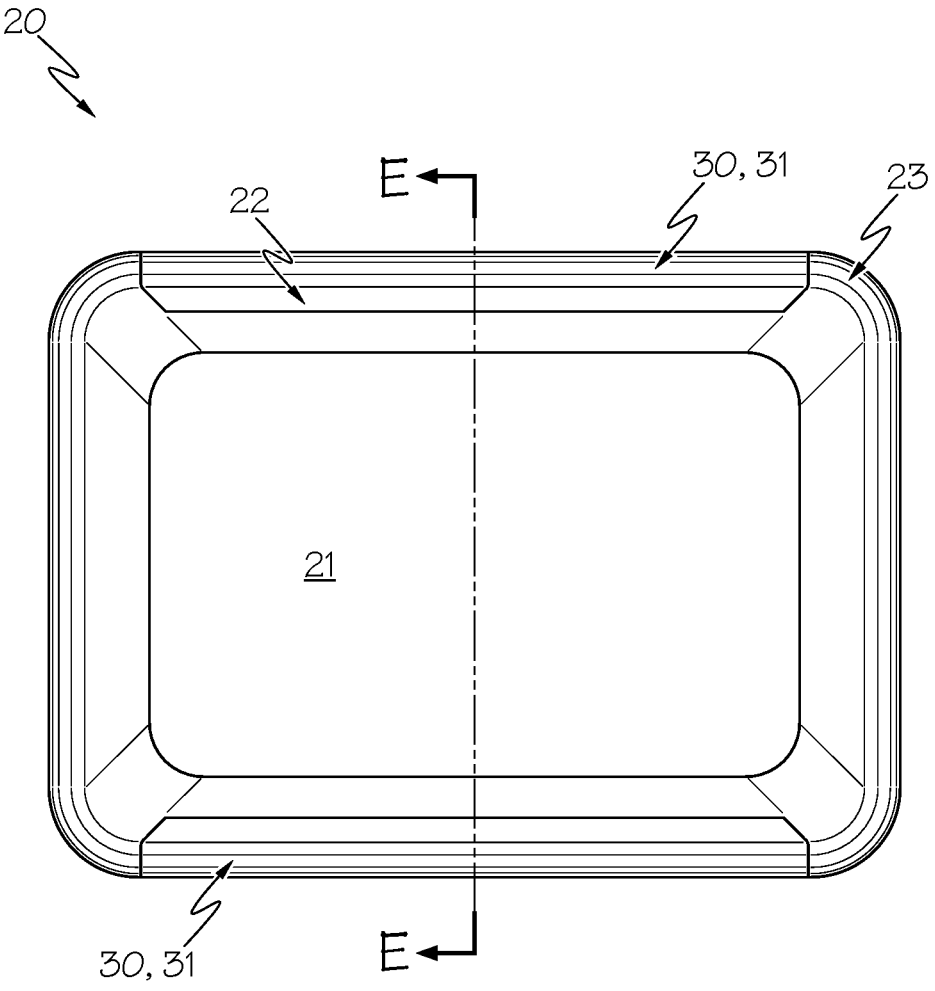
FIG. 12 is a bottom view of another exemplary paperboard tray of FIG. 1, including a paperboard reinforcement, according to another aspect of the present description.
Figure 13:
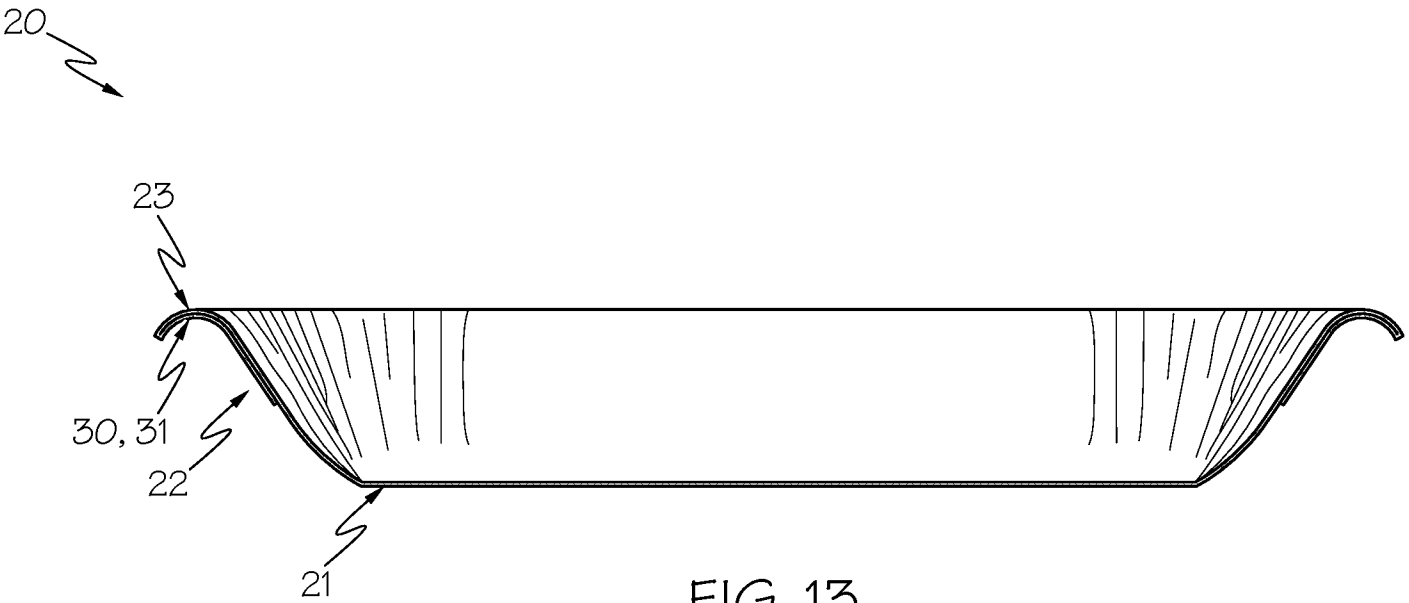
FIG. 13 is a side sectional view of the paperboard tray of FIG. 12 along section E-E.
Figure 14:
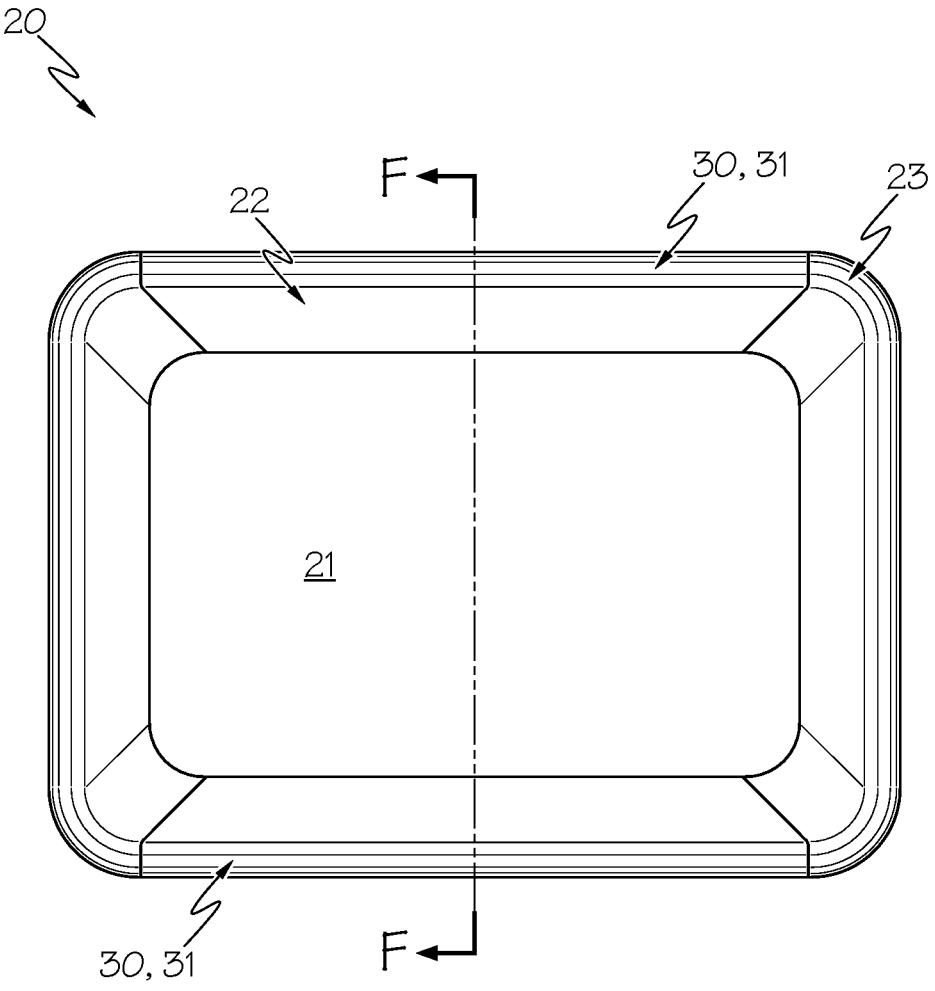
FIG. 14 is a bottom view of another exemplary paperboard tray of FIG. 1, including a paperboard reinforcement, according to another aspect of the present description.
Figure 15:
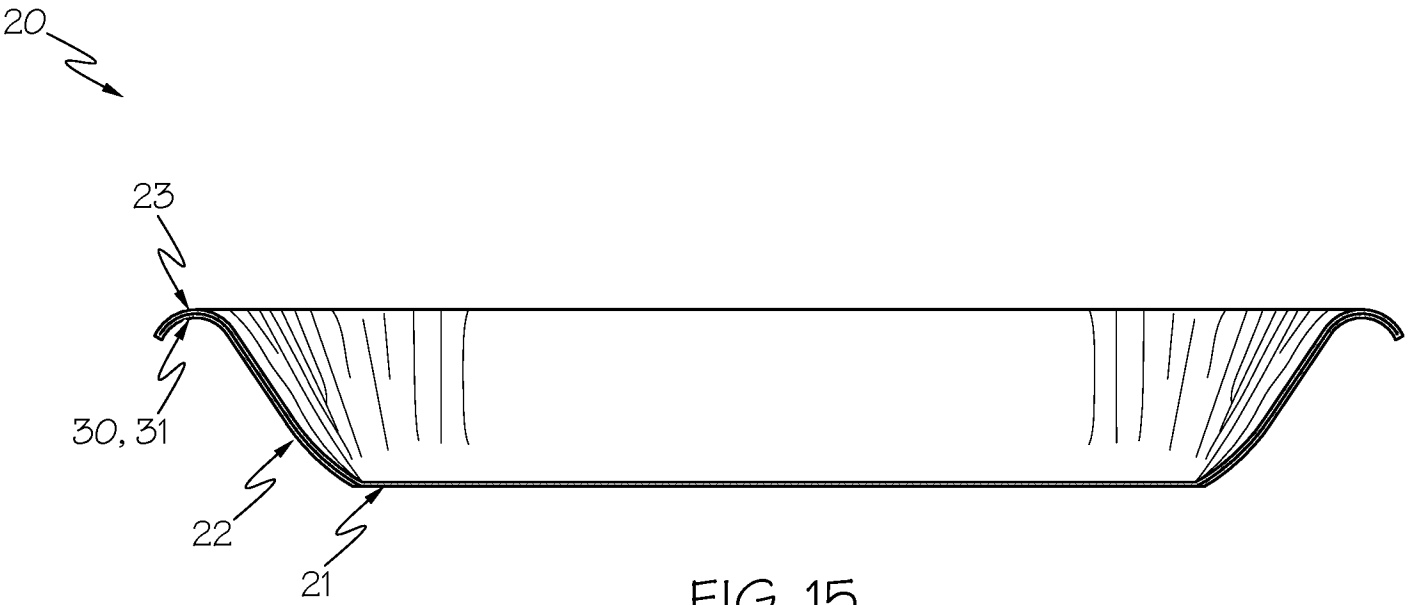
FIG. 15 is a side sectional view of the paperboard tray of FIG. 12 along section F-F.

FIGS. 12 to 15 illustrate a second example of an integral paperboard reinforcement 31. As shown, a rectangular paperboard tray 20 includes a coated paperboard 2 (FIG. 4) in the form of a bottom wall 21, a side wall 22 extending upwardly around the bottom wall 21, a curved flange 23 extending outwardly around the side wall 22, and the integral paperboard reinforcement 31 at an end of the flange 23. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21. The integral paperboard reinforcement 31 is attached to the bottom surface of the curved flange 23 and an outside surface of the side wall 22. By attaching the integral paperboard reinforcement 31 to the bottom surface of the curved flange 23 and the outside surface of the side wall 22, the integral paperboard reinforcement 31 reinforces the flange 23 and the side wall 22 to provide the flange 23 and the side wall 22 of the paperboard tray 20 with improved characteristics to withstand conveying the paperboard tray 20 through belts, holding the paperboard tray 20 at a fixed point, and using the paperboard tray 20 in an overwrapping process. By reinforcing the flange 23 and the side wall 22 rather than the flange 23, the side wall 22, and the bottom wall 21, less material is required for the paperboard tray 20 and better flexibility of the paperboard tray 20 is facilitated. In a specific example, as shown in FIGS. 12 and 13 the integral paperboard reinforcement 31 that is attached to the bottom surface of the curved flange 23 and the outside surface of the side wall 22 ends at the middle of the side wall 22. In another specific example, as shown in FIGS. 14 and 15, the integral paperboard reinforcement 31 that is attached to the bottom surface of the curved flange 23 and the outside surface of the side wall 22 ends at the bottom of the side wall 22.

Figure 16:
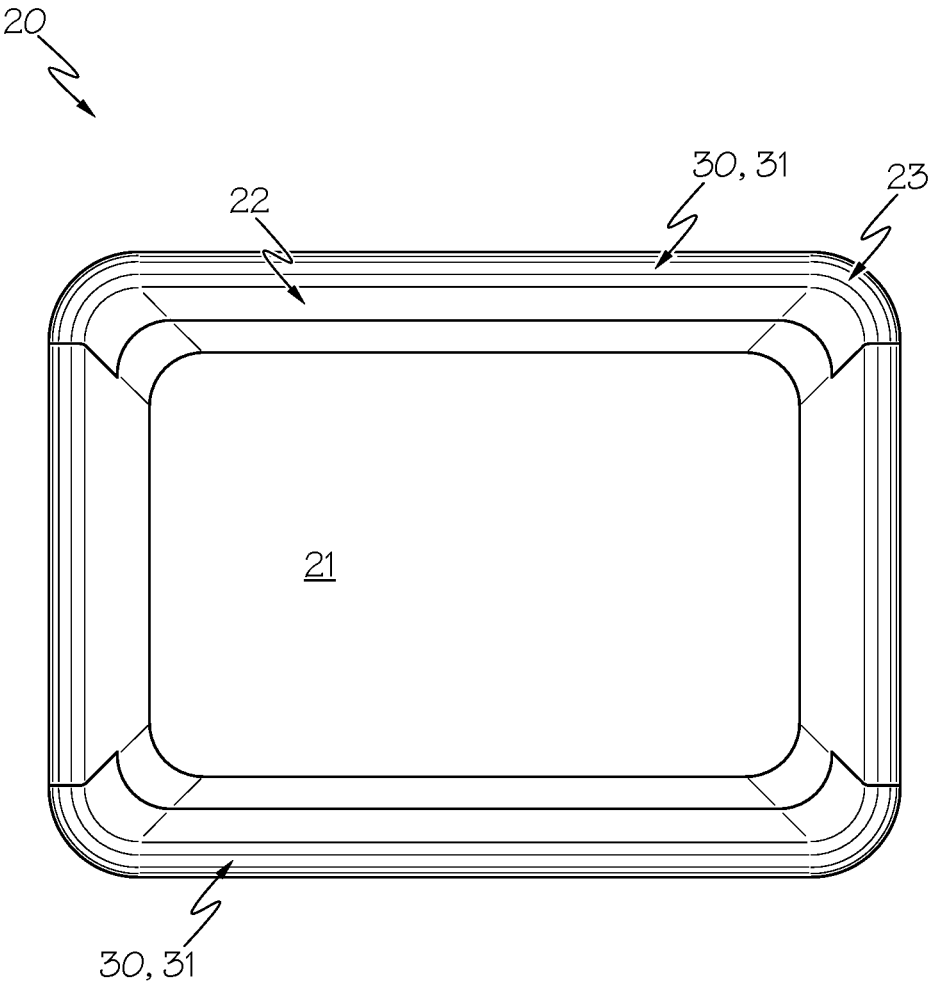
FIG. 16 is a bottom view of another exemplary paperboard tray of FIG. 1, including a paperboard reinforcement, according to another aspect of the present description.

In the examples shown in FIGS. 12 to 15, the integral paperboard reinforcement 31 is attached to the bottom surface of the flange 23 and the outer surface of the side wall 22 at both longitudinal ends of the rectangular paperboard tray 20. In an alternative, the integral paperboard reinforcement 31 may be attached to the bottom surface of the flange 23 and the outer surface of the side wall 22 at both latitudinal ends of the rectangular paperboard tray 20. In another alternative, the integral paperboard reinforcement 31 may be attached at the corners of the rectangular paperboard tray 20. In yet another alternative, the integral paperboard reinforcement 31 may be attached to the bottom surface of the flange 23 and the outer surface of the side wall 22 at both longitudinal ends and both latitudinal ends of the rectangular paperboard tray 20. In yet another alternative, the integral paperboard reinforcement 31 may be attached to the bottom surface of the flange 23 and the outer surface of the side wall 22 at either the longitudinal ends or both latitudinal ends of the rectangular paperboard tray 20 and the corners of the rectangular paperboard tray 20. In yet another alternative, the integral paperboard reinforcement 31 may be attached to the bottom surface of the flange 23 and the outer surface of the side wall 22 at both longitudinal ends, both latitudinal ends, and the corners of the rectangular paperboard tray 20. In other alternatives, the integral paperboard reinforcement 31 may be attached to the bottom surface of the flange 23 and the outer surface of the side wall 22 at one or more of the longitudinal ends, the latitudinal ends, and the corners of the rectangular paperboard tray 20 and attached to only the bottom surface of the flange 23 at other of the longitudinal ends, the latitudinal ends, and the corners of the rectangular paperboard tray 20. By way of example, FIG. 16 shows an exemplary paperboard tray 20 in which the integral paperboard reinforcement 31 is attached to the bottom surface of the flange 23 at the longitudinal ends of the rectangular paperboard tray 20 and the corners of the rectangular paperboard tray 20. Thus, the integral paperboard reinforcements 31 can stop short of the corners such as shown in FIGS. 12 and 14 or the integral paperboard reinforcements can extend to the corners of the paperboard tray 20 such as shown in FIG. 16. Stopping the integral paperboard reinforcements 31 short of the corners requires less material for the paperboard tray 20 and ensures better flexibility of the paperboard tray 20. Extending the integral paperboard reinforcements 31 to the corners of the paperboard tray 20 enhances strength of the flange 23 and also increases the overall strength of the paperboard tray 20. The integral paperboard reinforcements 31 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the integral paperboard reinforcements 31 to the corners of the paperboard tray 20 decreases the likelihood of buckling along the latitudinal or longitudinal ends and decreases the likelihood of bending in the corners which could torque the tray. Also, due to the integral nature of the integral paperboard reinforcement, the cut edges are redirected from areas of high purge/moisture concentration near the top of the tray to area of low purge/moisture concentration nearer to the bottom of the tray both at the straight edges of the latitudinal or longitudinal ends and at the corners of the paperboard tray. Other embodiments include that the paperboard tray 20 has a shape other than rectangular.

In the illustrated example as shown, the shape of the integral paperboard reinforcement 31 at the bottom surface of the flange 23 matches the shape of the flange 23. Alternatively, the integral paperboard reinforcement 31 at the bottom surface of the flange 23 may have a different shape than the bottom surface of the flange 23 such there is an air gap between the integral paperboard reinforcement 31 and the bottom surface of the flange 23. The air gap facilitates for de-nesting of multiple paperboard trays stacked upon each other in a nesting relationship. The air gap may be positioned at any point between the integral paperboard reinforcement 31 and the bottom surface of the flange 23. In an example, the air gap may be positioned between the integral paperboard reinforcement 31 and the bottom surface of the flange 23 at an end portion of the flange 23. In another example, the air gap may be positioned between the integral paperboard reinforcement 31 and the bottom surface of the flange 23 at a middle portion of the flange 23. In yet another, the air gap may be positioned between the integral paperboard reinforcement 31 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

Figure 17:
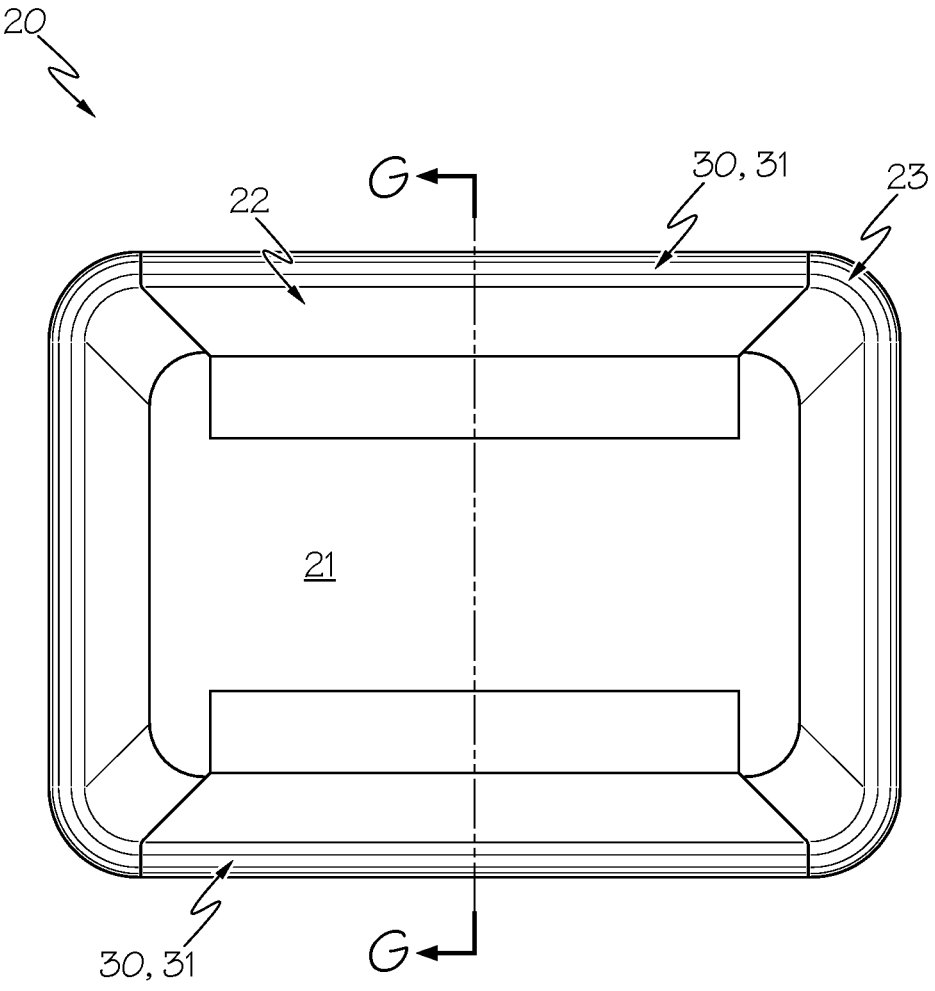
FIG. 17 is a bottom view of another exemplary paperboard tray of FIG. 1, including a paperboard reinforcement, according to yet another aspect of the present description.
Figure 18:
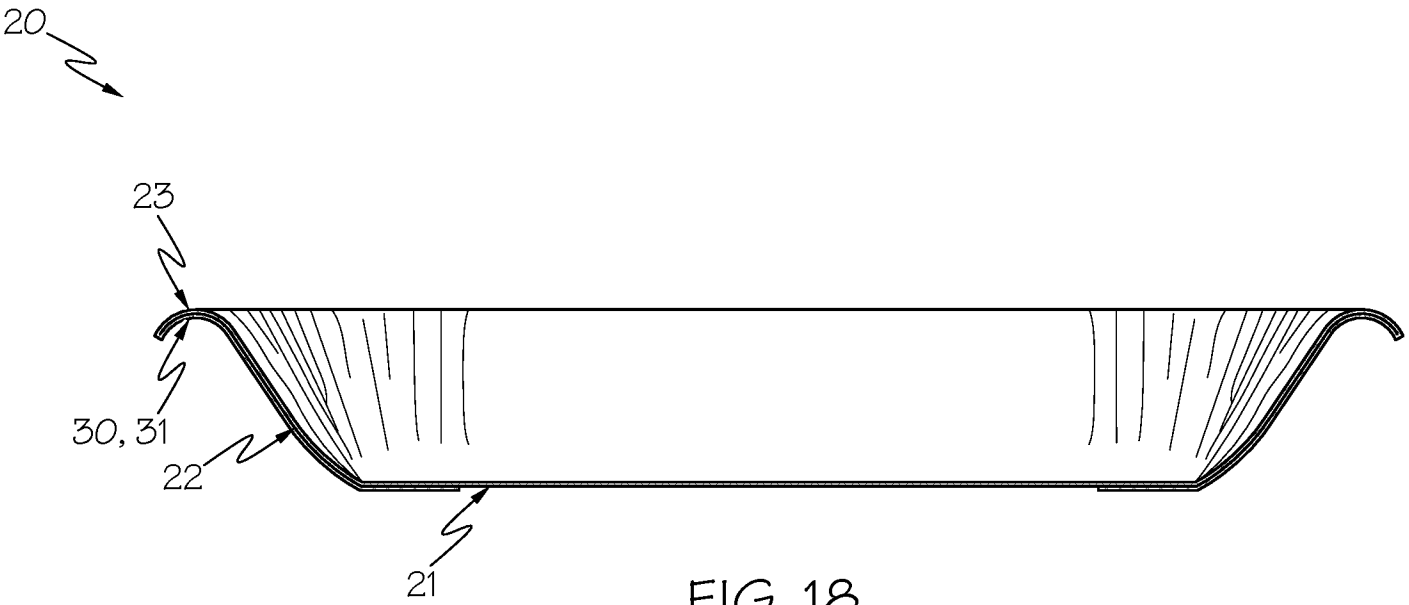
FIG. 18 is a side sectional view of the paperboard tray of FIG. 17 along section G-G.

FIGS. 17 and 18 illustrate a third example of an integral paperboard reinforcement 31. As shown, a rectangular paperboard tray 20 includes a coated paperboard 2 (FIG. 4) in the form of a bottom wall 21, a side wall 22 extending upwardly around the bottom wall 21, a curved flange 23 extending outwardly around the side wall 22, and the integral paperboard reinforcement 31 at an end of the flange 23. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21. The integral paperboard reinforcement 31 is attached to the bottom surface of the curved flange 23, an outside surface of the side wall 22, and the bottom surface of the bottom wall 21. By attaching the integral paperboard reinforcement 31 to the bottom surface of the curved flange 23, the outside surface of the side wall 22, and the bottom surface of the bottom wall 21, the integral paperboard reinforcement 31 reinforces the flange 23, the side wall 22, and the bottom wall 21 to provide the paperboard tray 20 with improved characteristics to withstand conveying the paperboard tray 20 through belts, holding the paperboard tray 20 at a fixed point, and using the paperboard tray 20 in an overwrapping process. As shown, only a portion of the bottom wall 21 is reinforced, leaving a remaining portion of the bottom wall 21 not reinforced by the integral paperboard reinforcement 31. By reinforcing the flange 23, the side wall 22, and a portion of the bottom wall 21 rather than the flange 23, the side wall 22, and the entire bottom wall 21, less material is required for the paperboard tray 20 and better flexibility of the paperboard tray 20 is facilitated. In a specific example, as shown in FIGS. 17 and 18, the integral paperboard reinforcement 31 that is attached to the bottom surface of the curved flange 23 and the outside surface of the side wall 22 ends before reaching a center of the bottom wall.

Figure 19:
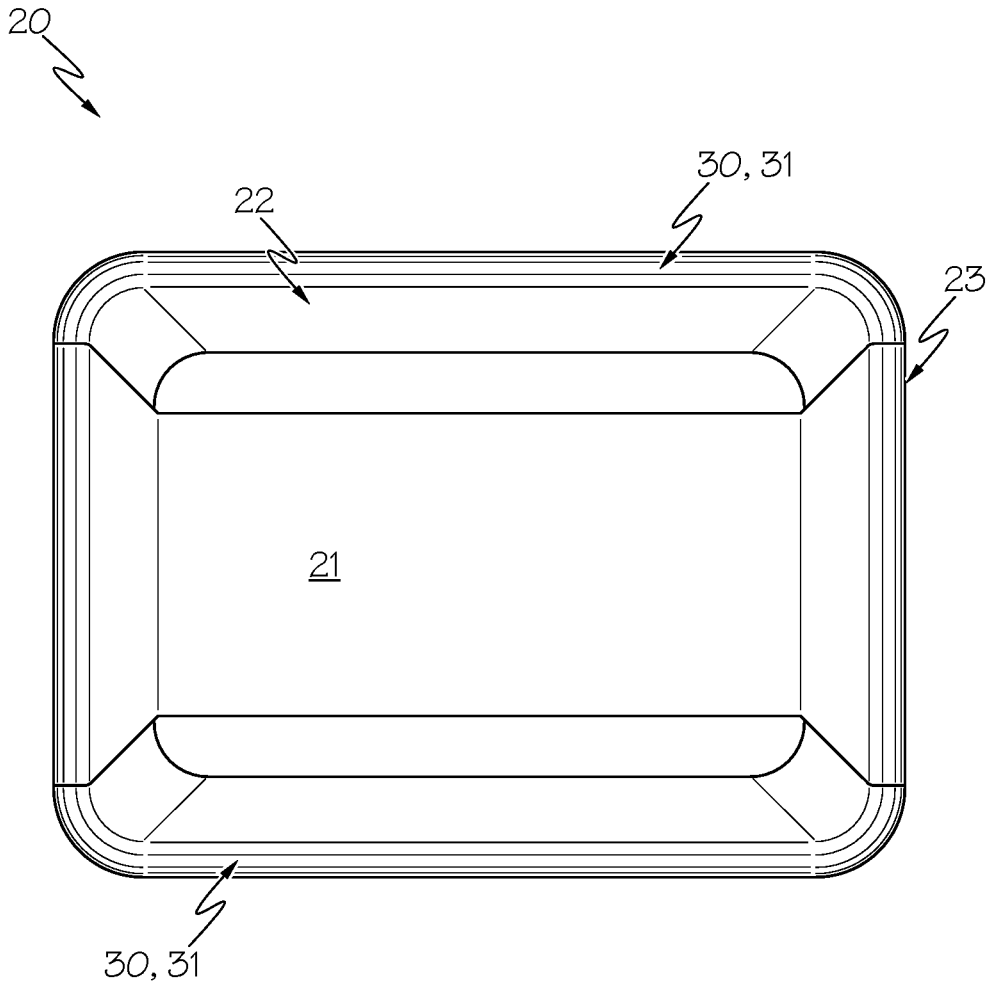
FIG. 19 is a bottom view of another exemplary paperboard tray of FIG. 1, including a paperboard reinforcement, according to yet another aspect of the present description.

In the example shown in FIGS. 17 and 18, integral paperboard reinforcement 31 is attached to the bottom surface of the flange 23, the outer surface of the side wall 22, and a portion of the bottom wall 21 at both longitudinal ends of the rectangular paperboard tray 20. In an alternative, the integral paperboard reinforcement 31 may be attached to the bottom surface of the flange 23, the outer surface of the side wall 22, and a portion of the bottom wall 21 at both latitudinal ends of the rectangular paperboard tray 20. In another alternative, the integral paperboard reinforcement 31 may be attached at the corners of the rectangular paperboard tray 20. In yet another alternative, the integral paperboard reinforcement 31 may be attached to the bottom surface of the flange 23, the outer surface of the side wall 22, and a portion of the bottom wall 21 at both longitudinal ends and both latitudinal ends of the rectangular paperboard tray 20. In yet another alternative, the integral paperboard reinforcement 31 may be attached to the bottom surface of the flange 23, the outer surface of the side wall 22, and a portion of the bottom wall 21 at either the longitudinal ends or both latitudinal ends of the rectangular paperboard tray 20 and the corners of the rectangular paperboard tray 20. In yet another alternative, the integral paperboard reinforcement 31 may be attached to the bottom surface of flange 23, the outer surface of the side wall 22, and a portion of the bottom wall 21 at both longitudinal ends, both latitudinal ends, and the corners of the rectangular paperboard tray 20. In other alternatives, the integral paperboard reinforcement 31 may be attached to the bottom surface of flange 23, the outer surface of the side wall 22, and a portion of the bottom wall 21 at one or more of the longitudinal ends, the latitudinal ends, and the corners of the rectangular paperboard tray 20 and attached to only the bottom surface of the flange 23 or to the bottom surface of the flange 23 and the outer surface of the side wall 22 at other of the longitudinal ends, the latitudinal ends, and the corners of the rectangular paperboard tray 20. By way of example, FIG. 19 shows an exemplary paperboard tray 20 in which the integral paperboard reinforcement 31 is attached to the bottom surface of the flange 23 at the longitudinal ends of the rectangular paperboard tray 20 and the corners of the rectangular paperboard tray 20. Thus, the integral paperboard reinforcements 31 can stop short of the corners such as shown in FIG. 17 or the integral paperboard reinforcements can extend to the corners of the paperboard tray 20 such as shown in FIG. 19. Stopping the integral paperboard reinforcements 31 short of the corners requires less material for the paperboard tray 20 and ensures better flexibility of the paperboard tray 20. Extending the integral paperboard reinforcements 31 to the corners of the paperboard tray 20 enhances strength of the flange 23 and also increases the overall strength of the paperboard tray 20. The integral paperboard reinforcements 31 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the integral paperboard reinforcements 31 to the corners of the paperboard tray 20 decreases the likelihood of buckling along the latitudinal or longitudinal ends and decreases the likelihood of bending in the corners which could torque the tray. Also, due to the integral nature of the integral paperboard reinforcement, the cut edges are redirected from areas of high purge/moisture concentration near the top of the tray to area of low purge/moisture concentration nearer to the bottom of the tray both at the straight edges of the latitudinal or longitudinal ends and at the corners of the paperboard tray. Other embodiments include that the paperboard tray 20 has a shape other than rectangular.

In the illustrated example as shown, the shape of the integral paperboard reinforcement 31 at the bottom surface of the flange 23 matches the shape of the flange 23. Alternatively, the integral paperboard reinforcement 31 at the bottom surface of the flange 23 may have a different shape than the bottom surface of the flange 23 such there is an air gap between the integral paperboard reinforcement 31 and the bottom surface of the flange 23. The air gap facilitates for de-nesting of multiple paperboard trays stacked upon each other in a nesting relationship. The air gap may be positioned at any point between the integral paperboard reinforcement 31 and the bottom surface of the flange 23. In an example, the air gap may be positioned between the integral paperboard reinforcement 31 and the bottom surface of the flange 23 at an end portion of the flange 23. In another example, the air gap may be positioned between the integral paperboard reinforcement 31 and the bottom surface of the flange 23 at a middle portion of the flange 23. In yet another, the air gap may be positioned between the integral paperboard reinforcement 31 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

Figure 20:
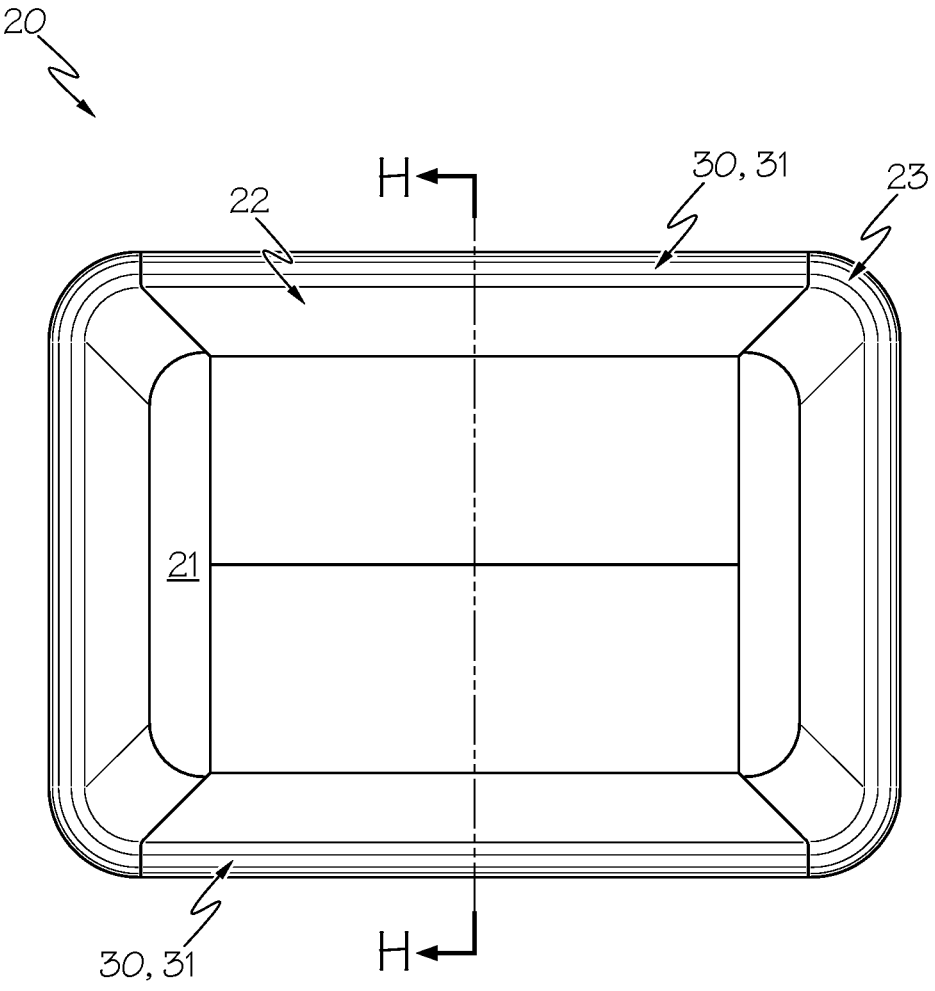
FIG. 20 is a bottom view of another exemplary paperboard tray of FIG. 1, including a paperboard reinforcement, according to yet another aspect of the present description.
Figure 21:
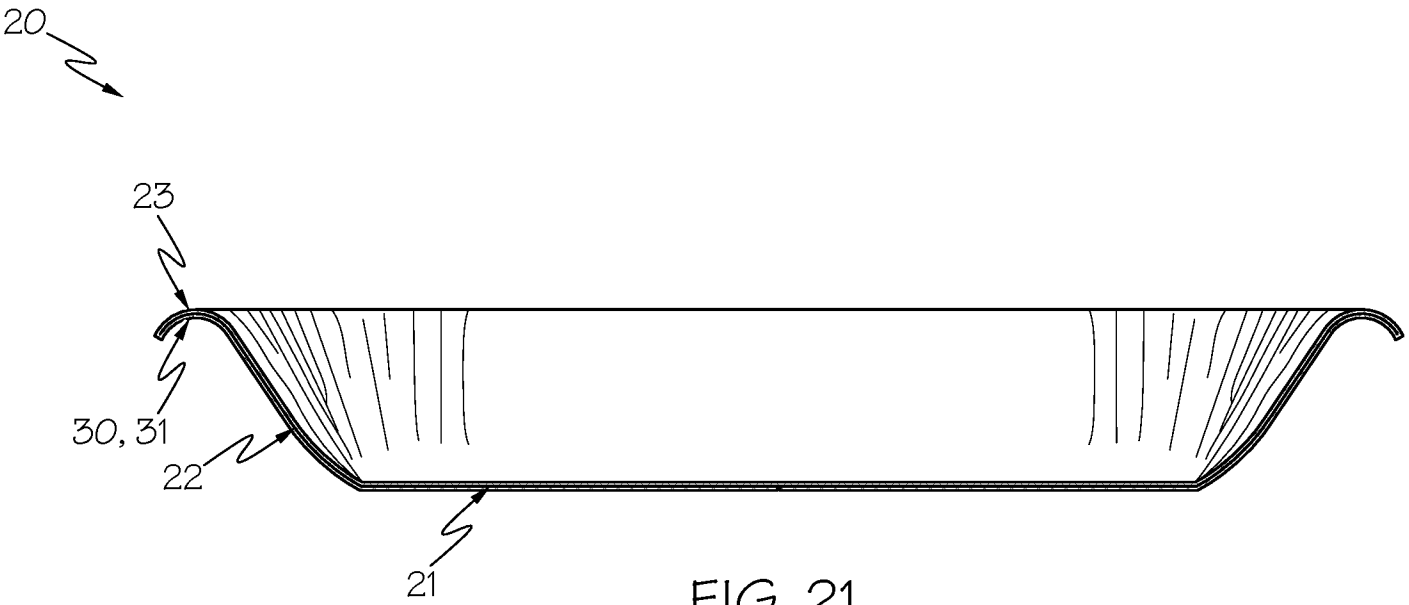
FIG. 21 is a side sectional view of the paperboard tray of FIG. 20 along section H-H.

FIGS. 20 and 21 illustrate a fourth example of an integral paperboard reinforcement 31. As shown, a rectangular paperboard tray 20 includes a coated paperboard 2 (FIG. 4) in the form of a bottom wall 21, a side wall 22 extending upwardly around the bottom wall 21, a curved flange 23 extending outwardly around the side wall 22, and the integral paperboard reinforcement 31 at an end of the flange 23. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21. The integral paperboard reinforcement 31 is attached to the bottom surface of the curved flange 23, an outside surface of the side wall 22, and the bottom surface of the bottom wall 21, in which the integral paperboard reinforcements 31 at opposing side of the of the paperboard tray 20 meet or overlap at the center. By attaching the integral paperboard reinforcement 31 to the bottom surface of the curved flange 23, the outside surface of the side wall 22, and the across the entire bottom surface of the bottom wall 21, the integral paperboard reinforcement 31 reinforces the flange 23, the side wall 22, and the entire bottom wall 21 to provide the paperboard tray 20 with improved characteristics to withstand conveying the paperboard tray 20 through belts, holding the paperboard tray 20 at a fixed point, and using the paperboard tray 20 in an overwrapping process.

Figure 22:
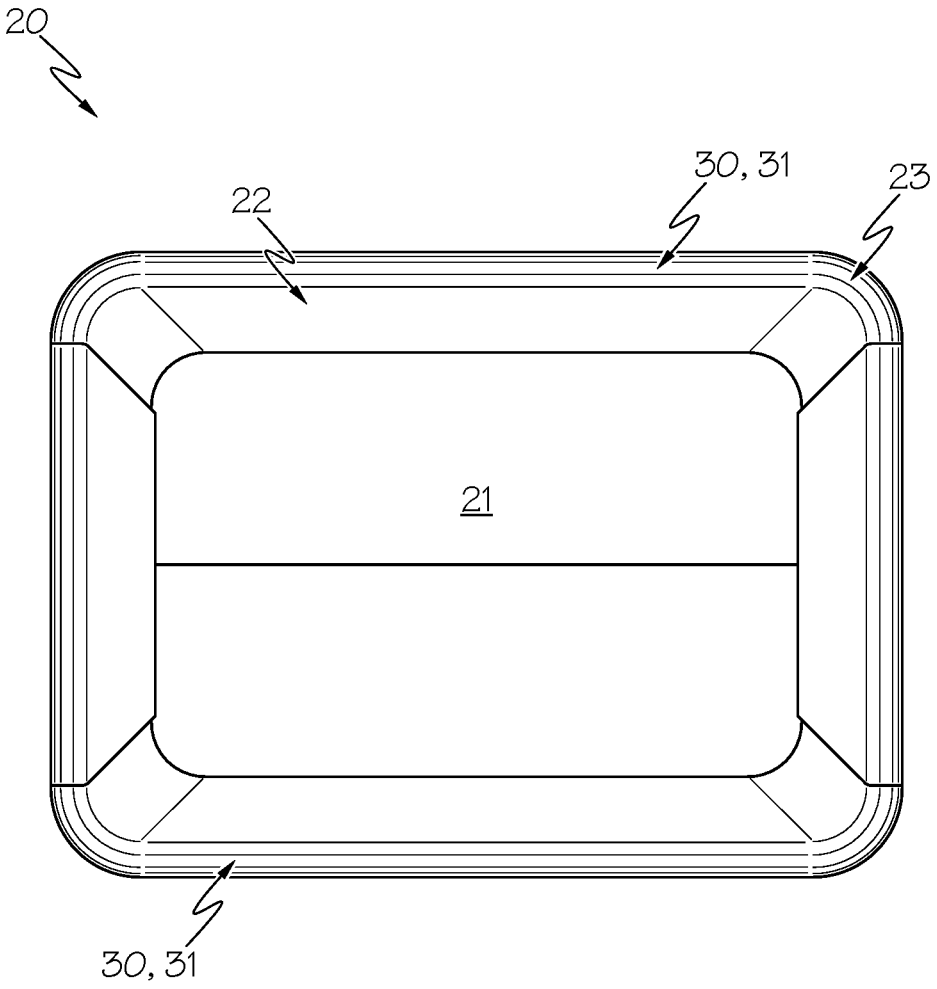
FIG. 22 is a bottom view of another exemplary paperboard tray of FIG. 1, including a paperboard reinforcement, according to yet another aspect of the present description.

In the example shown in FIGS. 20 and 21, integral paperboard reinforcement 31 is attached to the bottom surface of the flange 23, the outer surface of the side wall 22, and across the entire bottom wall 21 at both longitudinal ends of the rectangular paperboard tray 20. In an alternative, the integral paperboard reinforcement 31 may be attached to the bottom surface of the flange 23, the outer surface of the side wall 22, and across the entire bottom wall 21 at both latitudinal ends of the rectangular paperboard tray 20. In another alternative, the integral paperboard reinforcement 31 may be attached at the corners of the rectangular paperboard tray 20. In yet another alternative, the integral paperboard reinforcement 31 may be attached to the bottom surface of the flange 23, the outer surface of the side wall 22, and the entire bottom wall 21 at both longitudinal ends and both latitudinal ends of the rectangular paperboard tray 20. In yet another alternative, the integral paperboard reinforcement 31 may be attached to the bottom surface of the flange 23, the outer surface of the side wall 22, and across the entire bottom wall 21 at either the longitudinal ends or both latitudinal ends of the rectangular paperboard tray 20 and the corners of the rectangular paperboard tray 20. In yet another alternative, the integral paperboard reinforcement 31 may be attached to the bottom surface of flange 23, the outer surface of the side wall 22, and across the entire bottom wall 21 at both longitudinal ends, both latitudinal ends, and the corners of the rectangular paperboard tray 20. In other alternatives, the integral paperboard reinforcement 31 may be attached to the bottom surface of flange 23, the outer surface of the side wall 22, and across the entire bottom wall 21 at one or more of the longitudinal ends, the latitudinal ends, and the corners of the rectangular paperboard tray 20 and attached to only the bottom surface of the flange 23 or to the bottom surface of the flange 23 and the outer surface of the side wall 22 at other of the longitudinal ends, the latitudinal ends, and the corners of the rectangular paperboard tray 20. By way of example, FIG. 22 shows an exemplary paperboard tray 20 in which the integral paperboard reinforcement 31 is attached to the bottom surface of the flange 23 at the longitudinal ends of the rectangular paperboard tray 20 and the corners of the rectangular paperboard tray 20. Thus, the integral paperboard reinforcements 31 can stop short of the corners such as shown in FIG. 20 or the integral paperboard reinforcements can extend to the corners of the paperboard tray 20 such as shown in FIG. 22. Stopping the integral paperboard reinforcements 31 short of the corners requires less material for the paperboard tray 20 and ensures better flexibility of the paperboard tray 20. Extending the integral paperboard reinforcements 31 to the corners of the paperboard tray 20 enhances strength of the flange 23 and also increases the overall strength of the paperboard tray 20. The integral paperboard reinforcements 31 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the integral paperboard reinforcements 31 to the corners of the paperboard tray 20 decreases the likelihood of buckling along the latitudinal or longitudinal ends and decreases the likelihood of bending in the corners which could torque the tray. Also, due to the integral nature of the integral paperboard reinforcement, the cut edges are redirected from areas of high purge/moisture concentration near the top of the tray to area of low purge/moisture concentration nearer to the bottom of the tray both at the straight edges of the latitudinal or longitudinal ends and at the corners of the paperboard tray. Other embodiments include that the paperboard tray 20 has a shape other than rectangular.

In the illustrated example as shown, the shape of the integral paperboard reinforcement 31 at the bottom surface of the flange 23 matches the shape of the flange 23. Alternatively, the integral paperboard reinforcement 31 at the bottom surface of the flange 23 may have a different shape than the bottom surface of the flange 23 such there is an air gap between the integral paperboard reinforcement 31 and the bottom surface of the flange 23. The air gap facilitates for de-nesting of multiple paperboard trays stacked upon each other in a nesting relationship. The air gap may be positioned at any point between the integral paperboard reinforcement 31 and the bottom surface of the flange 23. In an example, the air gap may be positioned between the integral paperboard reinforcement 31 and the bottom surface of the flange 23 at an end portion of the flange 23. In another example, the air gap may be positioned between the integral paperboard reinforcement 31 and the bottom surface of the flange 23 at a middle portion of the flange 23. In yet another, the air gap may be positioned between the integral paperboard reinforcement 31 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

According to an embodiment of the present description, the paperboard reinforcement includes separate paperboard reinforcement attached to a bottom surface of the flange, wherein the separate paperboard reinforcement is formed from a separate piece of paperboard than the coated paperboard that forms the bottom wall, the side wall, and the flange. Examples of the separate paperboard reinforcement 32 are shown in FIGS. 23-30. The separate paperboard reinforcement increases strength of the flange to prevent buckling or kinking often due to stress while overwrapping or during distribution.

FIGS. 23-26 illustrate a first example of a separate paperboard reinforcement 32. As shown, a rectangular paperboard tray 20 includes a coated paperboard 2 (FIG. 4) in the form of a bottom wall 21, a side wall 22 extending upwardly around the bottom wall 21, and a curved flange 23 extending outwardly around the side wall 22. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21.

The separate paperboard reinforcement 32 is formed from a separate piece of paperboard than the coated paperboard 2 that forms the bottom wall, the side wall, and the flange. The coated paperboard 2 for the separate paperboard reinforcement 32 includes a single-ply paperboard substrate 4' and a barrier coating 10' on one side of the single-ply paperboard substrate 4' and optionally a topcoat 12' on the other side of the single-ply paperboard substrate 4'. As shown in FIG. 14, the barrier coating 10' may correspond to bottom surface of the separate paperboard reinforcement 32 opposite to the side of the separate paperboard reinforcement 32 contacting the flange 23. Alternatively, as shown in FIG. 15, the barrier coating 10' may correspond to upper surface of the separate paperboard reinforcement 32 on the side of the separate paperboard reinforcement 32 contacting the flange 23.

The separate paperboard reinforcement 32 is attached to the bottom surface of the curved flange 23. By attaching the separate paperboard reinforcement 32 to the bottom surface of the curved flange 23, the separate paperboard reinforcement 32 reinforces the flange 23 to provide the flange 23 of the paperboard tray 20 with improved characteristics to withstand conveying the paperboard tray 20 through belts, holding the paperboard tray 20 at a fixed point, and using the paperboard tray 20 in an overwrapping process. By reinforcing the flange 23 rather than the flange 23, the side wall 22, and the bottom wall 21, less material is required for the paperboard tray 20 and better flexibility of the paperboard tray 20 is facilitated.

Figure 23:
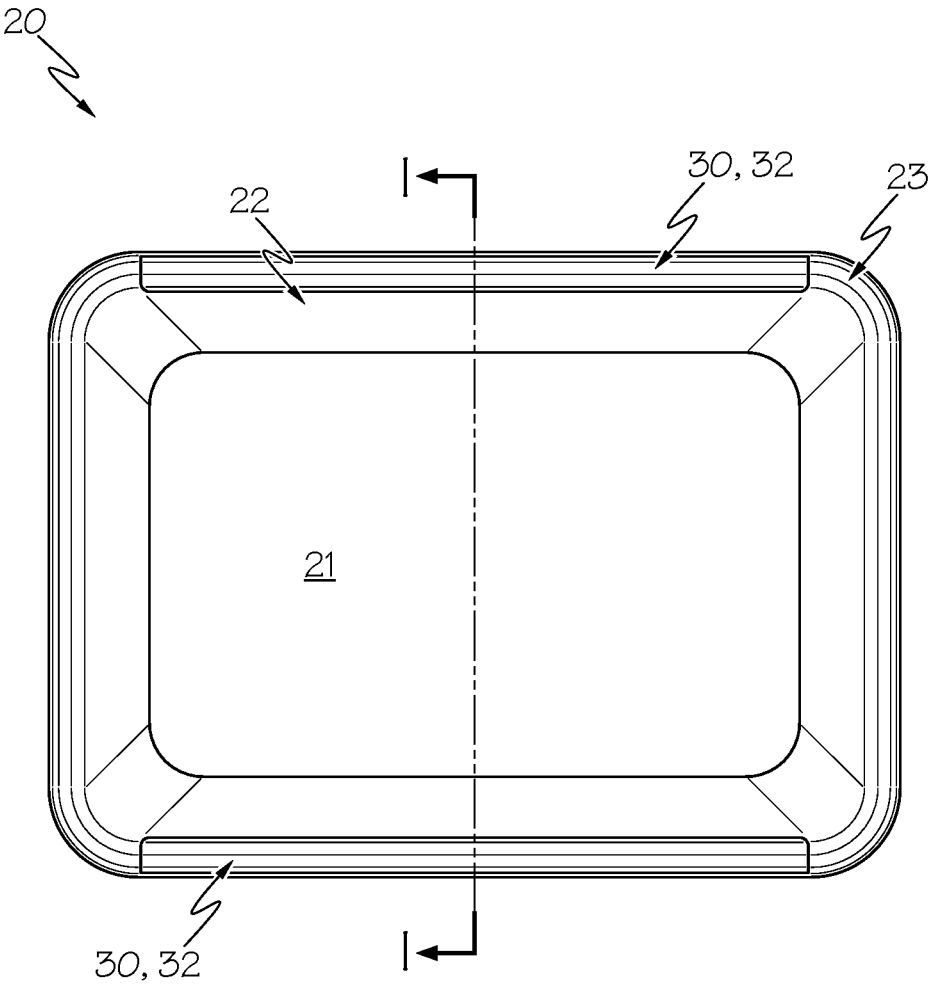
FIG. 23 is a bottom view of another exemplary paperboard tray of FIG. 1, including a paperboard reinforcement, according to yet another aspect of the present description.
Figure 24:
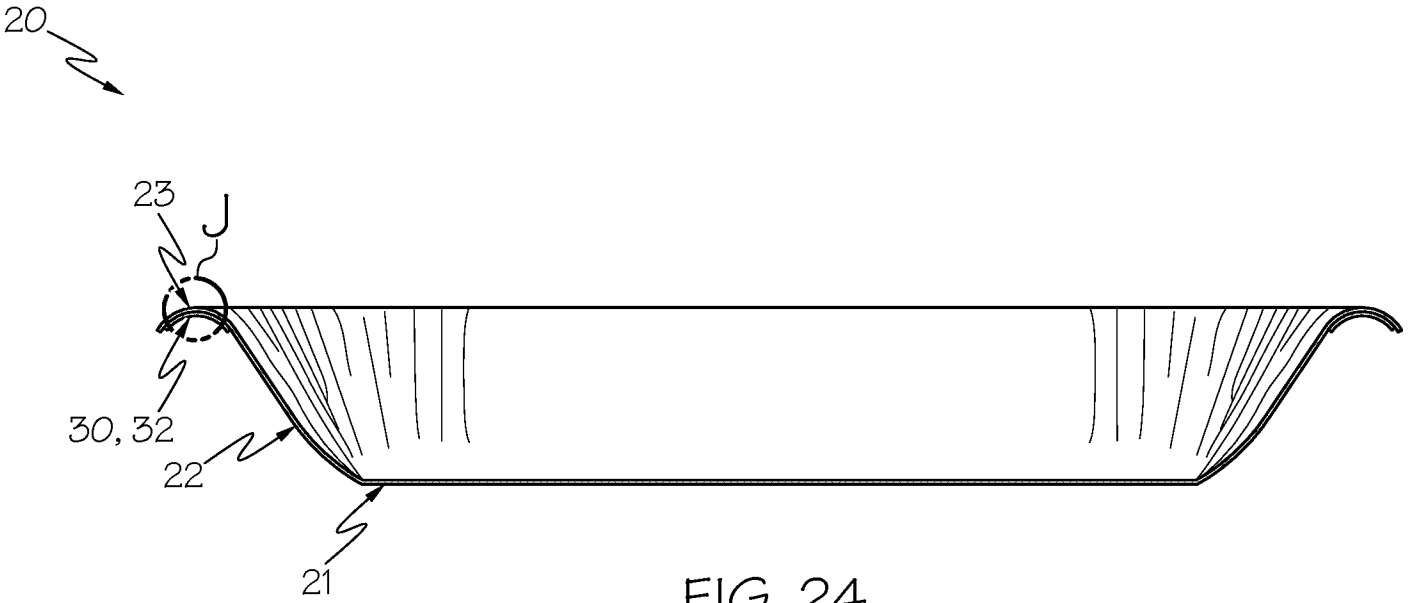
FIG. 24 is a side sectional view of the paperboard tray of FIG. 23 along section I-I.

In the example shown in FIGS. 23-26 separate paperboard reinforcement 32 is attached to the bottom surface of the flange 23 at both longitudinal ends of the rectangular paperboard tray 20. In an alternative, the separate paperboard reinforcement 32 may be attached to the bottom surface of the flange 23 at both latitudinal ends of the rectangular paperboard tray 20. In another alternative, the separate paperboard reinforcement 32 may be attached at the corners of the rectangular paperboard tray 20. In yet another alternative, the separate paperboard reinforcement 32 may be attached to the bottom surface of the flange 23 at both longitudinal ends and both latitudinal ends of the rectangular paperboard tray 20. In yet another alternative, the separate paperboard reinforcement 32 may be attached to the bottom surface of the flange 23 at either the longitudinal ends or both latitudinal ends of the rectangular paperboard tray 20 and the corners of the rectangular paperboard tray 20. In yet another alternative, the separate paperboard reinforcement 32 may be attached to the bottom surface of the flange 23 at both longitudinal ends, both latitudinal ends, and the corners of the rectangular paperboard tray 20. Thus, the separate paperboard reinforcements 32 can stop short of the corners such as shown in FIG. 23 or the separate paperboard reinforcements 32 can extend to the corners of the paperboard tray 20. Stopping the separate paperboard reinforcements 32 short of the corners requires less material for the paperboard tray 20 and ensures better flexibility of the paperboard tray 20. Extending the separate paperboard reinforcements 32 to the corners of the paperboard tray 20 enhances strength of the flange 23 and also increases the overall strength of the paperboard tray 20. The separate paperboard reinforcements 32 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the separate paperboard reinforcements 32 to the corners of the paperboard tray 20 decreases the likelihood of buckling along the latitudinal or longitudinal ends and decreases the likelihood of bending in the corners which could torque the tray. Other embodiments include that the paperboard tray 20 has a shape other than rectangular.

In the illustrated example as shown, the shape of the separate paperboard reinforcement 32 at the bottom surface of the flange 23 matches the shape of the flange 23. Alternatively, the separate paperboard reinforcement 32 at the bottom surface of the flange 23 may have a different shape than the bottom surface of the flange 23 such there is an air gap between the separate paperboard reinforcement 32 and the bottom surface of the flange 23. The air gap facilitates for de-nesting of multiple paperboard trays stacked upon each other in a nesting relationship. The air gap may be positioned at any point between the separate paperboard reinforcement 32 and the bottom surface of the flange 23. In an example, the air gap may be positioned between the separate paperboard reinforcement 32 and the bottom surface of the flange 23 at an end portion of the flange 23. In another example, the air gap may be positioned between the separate paperboard reinforcement 32 and the bottom surface of the flange 23 at a middle portion of the flange 23. In yet another, the air gap may be positioned between the separate paperboard reinforcement 32 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

Figure 27:
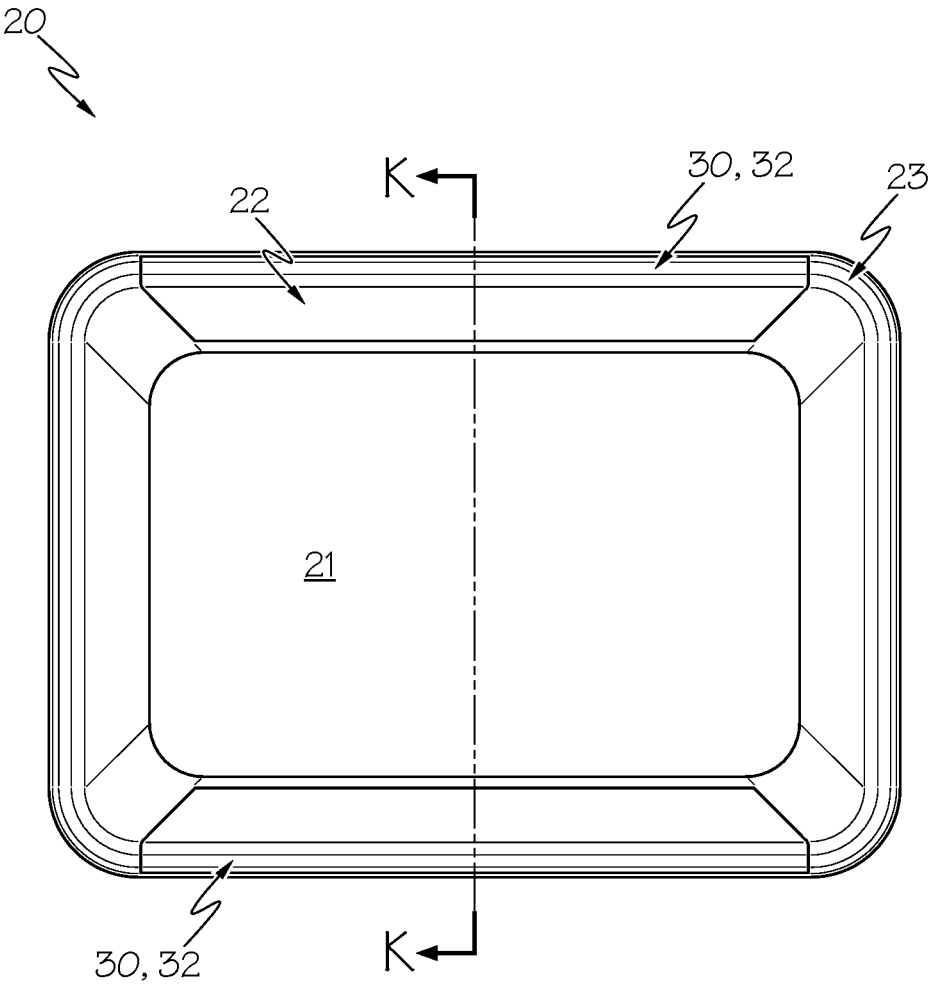
FIG. 27 is a bottom view of yet another exemplary paperboard tray of FIG. 1, including a paperboard reinforcement, according to yet another aspect of the present description.
Figure 28:
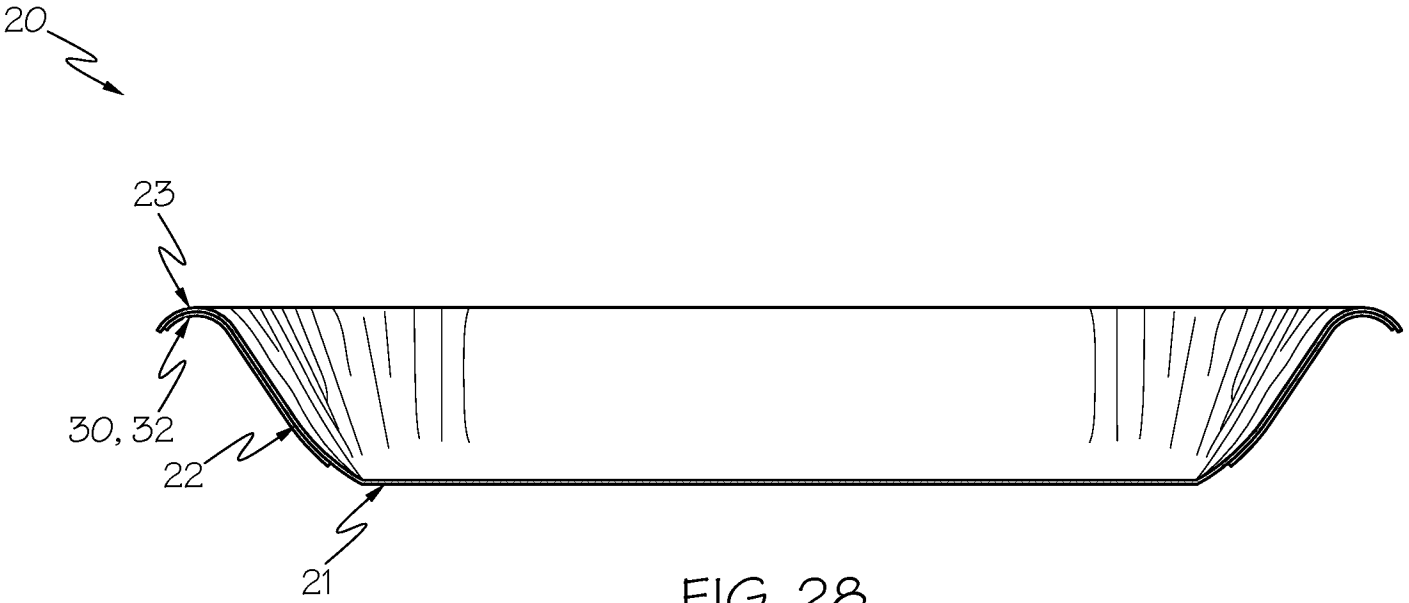
FIG. 28 is a side sectional view of the paperboard tray of FIG. 27 along section K-K.

FIGS. 27 and 28 illustrate a second example of a separate paperboard reinforcement 32. As shown, a rectangular paperboard tray 20 includes a coated paperboard 2 (FIG. 4) in the form of a bottom wall 21, a side wall 22 extending upwardly around the bottom wall 21, and a curved flange 23 extending outwardly around the side wall 22. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21.

Figure 25:
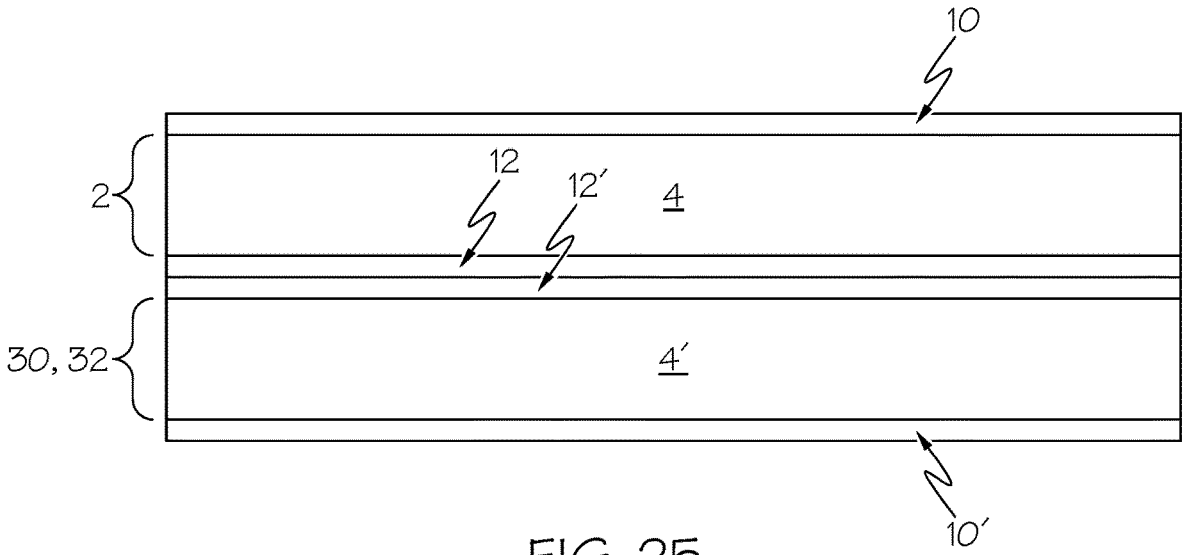
FIG. 25 is a cross-section of the paperboard tray within circle J of FIG. 24, according to one aspect.
Figure 26:
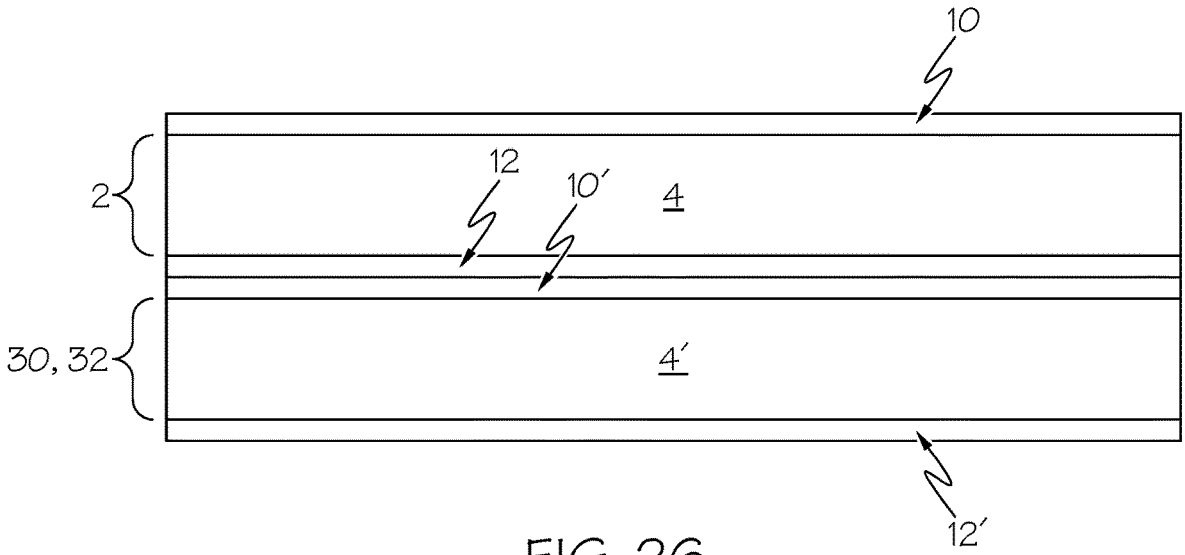
FIG. 26 is a cross-section of the paperboard tray within circle J of FIG. 24, according to another aspect.

The separate paperboard reinforcement 32 is formed from a separate piece of paperboard than the coated paperboard 2 that forms the bottom wall, the side wall, and the flange. The coated paperboard 2 for the separate paperboard reinforcement 32 includes a single-ply paperboard substrate 4' and a barrier coating 10' on one side of the single-ply paperboard substrate 4' and optionally a topcoat 12' on the other side of the single-ply paperboard substrate 4'. As shown in FIG. 25, the barrier coating 10' may correspond to bottom surface of the separate paperboard reinforcement 32 opposite to the side of the separate paperboard reinforcement 32 contacting the flange 23 and the side wall 22. Alternatively, as shown in FIG. 26, the barrier coating 10' may correspond to upper surface of the separate paperboard reinforcement 32 on the side of the separate paperboard reinforcement 32 contacting the flange 23 and the side wall 22.

The separate paperboard reinforcement 32 is attached to the bottom surface of the curved flange 23 and an outside surface of the side wall 22. By attaching the separate paperboard reinforcement 32 to the bottom surface of the curved flange 23 and the outside surface of the side wall 22, the separate paperboard reinforcement 32 reinforces the flange 23 and the side wall 22 to provide the flange 23 and the side wall 22 of the paperboard tray 20 with improved characteristics to withstand conveying the paperboard tray 20 through belts, holding the paperboard tray 20 at a fixed point, and using the paperboard tray 20 in an overwrapping process. By reinforcing the flange 23 and the side wall 22 rather than the flange 23, the side wall 22, and the bottom wall 21, less material is required for the paperboard tray 20 and better flexibility of the paperboard tray 20 is facilitated.

In the example shown in FIGS. 27 and 28, separate paperboard reinforcement 32 is attached to the bottom surface of the flange 23 and the outer surface of the side wall 22 at both longitudinal ends of the rectangular paperboard tray 20. In an alternative, the separate paperboard reinforcement 32 may be attached to the bottom surface of the flange 23 and the outer surface of the side wall 22 at both latitudinal ends of the rectangular paperboard tray 20. In another alternative, the separate paperboard reinforcement 32 may be attached at the corners of the rectangular paperboard tray 20. In yet another alternative, the separate paperboard reinforcement 32 may be attached to the bottom surface of the flange 23 and the outer surface of the side wall 22 at both longitudinal ends and both latitudinal ends of the rectangular paperboard tray 20. In yet another alternative, the separate paperboard reinforcement 32 may be attached to the bottom surface of the flange 23 and the outer surface of the side wall 22 at either the longitudinal ends or both latitudinal ends of the rectangular paperboard tray 20 and the corners of the rectangular paperboard tray 20. In yet another alternative, the separate paperboard reinforcement 32 may be attached to the bottom surface of the flange 23 and the outer surface of the side wall 22 at both longitudinal ends, both latitudinal ends, and the corners of the rectangular paperboard tray 20. In other alternatives, the separate paperboard reinforcement 32 may be attached to the bottom surface of the flange 23 and the outer surface of the side wall 22 at one or more of the longitudinal ends, the latitudinal ends, and the corners of the rectangular paperboard tray 20 and attached to only the bottom surface of the flange 23 at other of the longitudinal ends, the latitudinal ends, and the corners of the rectangular paperboard tray 20. Thus, the separate paperboard reinforcements 32 can stop short of the corners such as shown in FIG. 27 or the separate paperboard reinforcements 32 can extend to the corners of the paperboard tray 20. Stopping the separate paperboard reinforcements 32 short of the corners requires less material for the paperboard tray 20 and ensures better flexibility of the paperboard tray 20. Extending the separate paperboard reinforcements 32 to the corners of the paperboard tray 20 enhances strength of the flange 23 and also increases the overall strength of the paperboard tray 20. The separate paperboard reinforcements 32 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the separate paperboard reinforcements 32 to the corners of the paperboard tray 20 decreases the likelihood of buckling along the latitudinal or longitudinal ends and decreases the likelihood of bending in the corners which could torque the tray. Other embodiments include that the paperboard tray 20 has a shape other than rectangular.

In the illustrated example as shown, the shape of the separate paperboard reinforcement 32 at the bottom surface of the flange 23 matches the shape of the flange 23. Alternatively, the separate paperboard reinforcement 32 at the bottom surface of the flange 23 may have a different shape than the bottom surface of the flange 23 such there is an air gap between the separate paperboard reinforcement 32 and the bottom surface of the flange 23. The air gap facilitates for de-nesting of multiple paperboard trays stacked upon each other in a nesting relationship. The air gap may be positioned at any point between the separate paperboard reinforcement 32 and the bottom surface of the flange 23. In an example, the air gap may be positioned between the separate paperboard reinforcement 32 and the bottom surface of the flange 23 at an end portion of the flange 23. In another example, the air gap may be positioned between the separate paperboard reinforcement 32 and the bottom surface of the flange 23 at a middle portion of the flange 23. In yet another, the air gap may be positioned between the separate paperboard reinforcement 32 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

Figure 29:
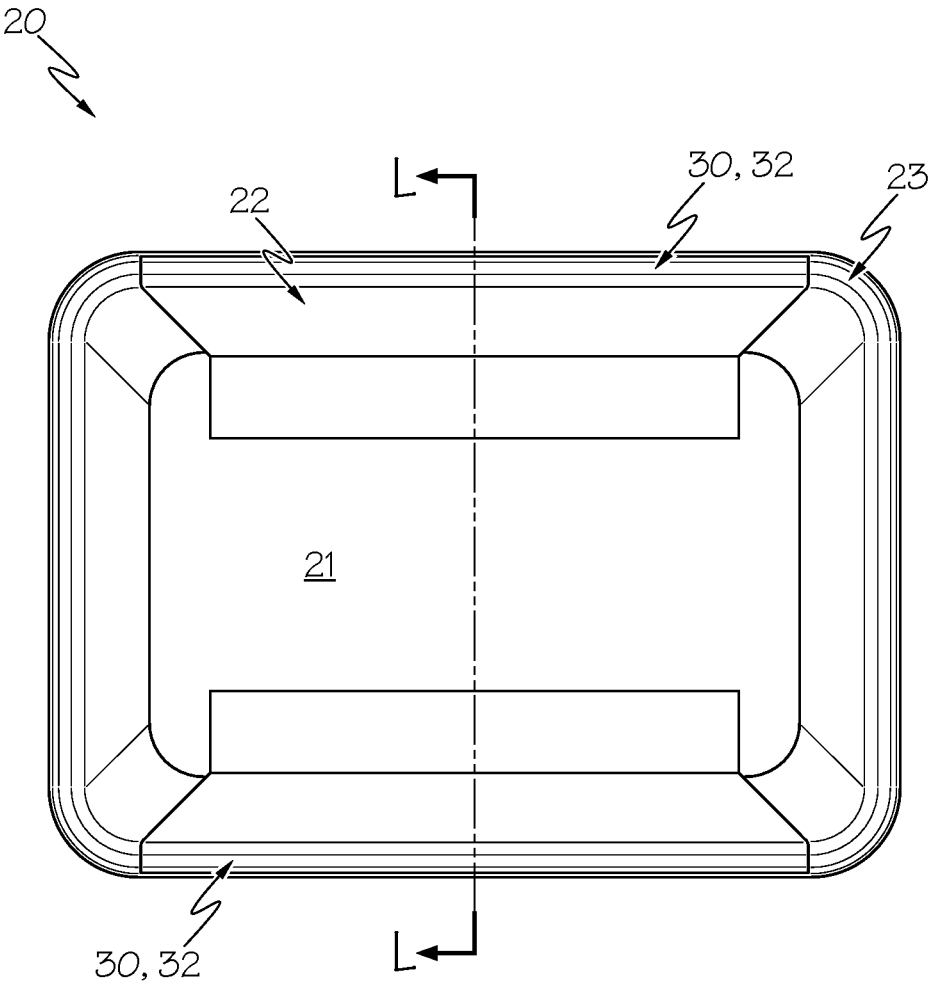
FIG. 29 is a bottom view of yet another exemplary paperboard tray of FIG. 1, including a paperboard reinforcement, according to yet another aspect of the present description.
Figure 30:
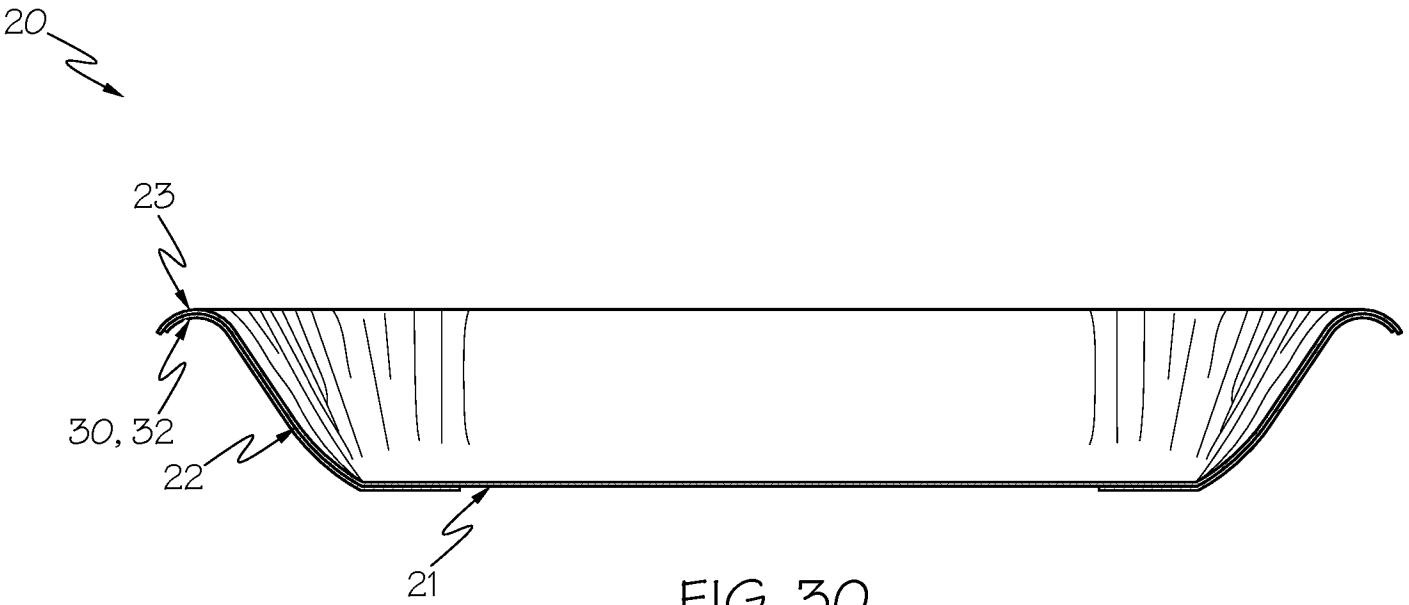
FIG. 30 is a side sectional view of the paperboard tray of FIG. 29 along section L-L.

FIGS. 29 and 30 illustrate a third example of a separate paperboard reinforcement. As shown, a rectangular paperboard tray 20 includes a coated paperboard 2 (FIG. 4) in the form of a bottom wall 21, a side wall 22 extending upwardly around the bottom wall 21, and a curved flange 23 extending outwardly around the side wall 22. The coated paperboard 2 includes a single-ply paperboard substrate 4 and a barrier coating 10 on the side of the single-ply paperboard substrate 4 that corresponds to an upper side of the bottom wall 21 and optionally a topcoat 12 on the side of the single-ply paperboard substrate 4 that corresponds to a lower side of the bottom wall 21.

The separate paperboard reinforcement 32 is formed from a separate piece of paperboard than the coated paperboard 2 that forms the bottom wall, the side wall, and the flange. The coated paperboard 2 for the separate paperboard reinforcement 32 includes a single-ply paperboard substrate 4' and a barrier coating 10' on one side of the single-ply paperboard substrate 4' and optionally a topcoat 12' on the other side of the single-ply paperboard substrate 4'. As shown in FIG. 25, the barrier coating 10' may correspond to bottom surface of the separate paperboard reinforcement 32 opposite to the side of the separate paperboard reinforcement 32 contacting the flange 23, the side wall 22, and the bottom wall 21. Alternatively, as shown in FIG. 26, the barrier coating 10' may correspond to upper surface of the separate paperboard reinforcement 32 on the side of the separate paperboard reinforcement 32 contacting the flange 23, the side wall 22, and the bottom wall 21.

The separate paperboard reinforcement 32 is attached to the bottom surface of the curved flange 23, the outside surface of the side wall 22, and the bottom surface of the bottom wall 21. By attaching the separate paperboard reinforcement 32 to the bottom surface of the curved flange 23, the outside surface of the side wall 22, and the bottom surface of the bottom wall 21, the separate paperboard reinforcement 32 reinforces the flange 23, the side wall 22, and the bottom wall 21 to provide the flange 23, the side wall 22, and the bottom wall 21 of the paperboard tray 20 with improved characteristics to withstand conveying the paperboard tray 20 through belts, holding the paperboard tray 20 at a fixed point, and using the paperboard tray 20 in an overwrapping process. As shown, only a portion of the bottom wall 21 is reinforced, leaving a remaining portion of the bottom wall 21 not reinforced by the separate paperboard reinforcement 32. By reinforcing the flange 23, the side wall 22, and a portion of the bottom wall 21 rather than the flange 23, the side wall 22, and the entire bottom wall 21, less material is required for the paperboard tray 20 and better flexibility of the paperboard tray 20 is facilitated.

In the example shown in FIGS. 29 and 30, separate paperboard reinforcement 32 is attached to the bottom surface of the flange 23, the outer surface of the side wall 22, and a portion of the bottom wall 21 at both longitudinal ends of the rectangular paperboard tray 20. In an alternative, the separate paperboard reinforcement 32 may be attached to the bottom surface of the flange 23, the outer surface of the side wall 22, and a portion of the bottom wall 21 at both latitudinal ends of the rectangular paperboard tray 20. In another alternative, the separate paperboard reinforcement 32 may be attached at the corners of the rectangular paperboard tray 20. In yet another alternative, the separate paperboard reinforcement 32 may be attached to the bottom surface of the flange 23, the outer surface of the side wall 22, and a portion of the bottom wall 21 at both longitudinal ends and both latitudinal ends of the rectangular paperboard tray 20. In yet another alternative, the separate paperboard reinforcement 32 may be attached to the bottom surface of the flange 23, the outer surface of the side wall 22, and a portion of the bottom wall 21 at either the longitudinal ends or both latitudinal ends of the rectangular paperboard tray 20 and the corners of the rectangular paperboard tray 20. In yet another alternative, the separate paperboard reinforcement 32 may be attached to the bottom surface of flange 23, the outer surface of the side wall 22, and a portion of the bottom wall 21 at both longitudinal ends, both latitudinal ends, and the corners of the rectangular paperboard tray 20. In other alternatives, the separate paperboard reinforcement 32 may be attached to the bottom surface of flange 23, the outer surface of the side wall 22, and a portion of the bottom wall 21 at one or more of the longitudinal ends, the latitudinal ends, and the corners of the rectangular paperboard tray 20 and attached to only the bottom surface of the flange 23 or to the bottom surface of the flange 23 and the outer surface of the side wall 22 at other of the longitudinal ends, the latitudinal ends, and the corners of the rectangular paperboard tray 20. Thus, the separate paperboard reinforcements 32 can stop short of the corners such as shown in FIG. 29 or the separate paperboard reinforcements 32 can extend to the corners of the paperboard tray 20. Stopping the separate paperboard reinforcements 32 short of the corners requires less material for the paperboard tray 20 and ensures better flexibility of the paperboard tray 20. Extending the separate paperboard reinforcements 32 to the corners of the paperboard tray 20 enhances strength of the flange 23 and also increases the overall strength of the paperboard tray 20. The separate paperboard reinforcements 32 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the separate paperboard reinforcements 32 to the corners of the paperboard tray 20 decreases the likelihood of buckling along the latitudinal or longitudinal ends and decreases the likelihood of bending in the corners which could torque the tray. Other embodiments include that the paperboard tray 20 has a shape other than rectangular.

In the illustrated example as shown, the shape of the separate paperboard reinforcement 32 at the bottom surface of the flange 23 matches the shape of the flange 23. Alternatively, the separate paperboard reinforcement 32 at the bottom surface of the flange 23 may have a different shape than the bottom surface of the flange 23 such there is an air gap between the separate paperboard reinforcement 32 and the bottom surface of the flange 23. The air gap facilitates for de-nesting of multiple paperboard trays stacked upon each other in a nesting relationship. The air gap may be positioned at any point between the separate paperboard reinforcement 32 and the bottom surface of the flange 23. In an example, the air gap may be positioned between the separate paperboard reinforcement 32 and the bottom surface of the flange 23 at an end portion of the flange 23. In another example, the air gap may be positioned between the separate paperboard reinforcement 32 and the bottom surface of the flange 23 at a middle portion of the flange 23. In yet another, the air gap may be positioned between the separate paperboard reinforcement 32 and the bottom surface of the flange 23 at a beginning portion of the flange 23 near the side wall 22. The purpose of the air gaps is to produce a section of the reinforced flange that aids in separating the paperboard trays when stacked on each other, which can be useful for de-nesting of the paperboard trays.

In a fourth example of a separate paperboard reinforcement (not shown), the separate paperboard reinforcement 32 may be attached to the bottom surface of the curved flange 23, an outside surface of the side wall 22, and the bottom surface of the bottom wall 21, in which the integral paperboard reinforcements 31 at opposing side of the of the paperboard tray 20 meet or overlap at the center. By attaching the separate paperboard reinforcement 32 to the bottom surface of the curved flange 23, the outside surface of the side wall 22, and the across the entire bottom surface of the bottom wall 21, the separate paperboard reinforcement 32 reinforces the flange 23, the side wall 22, and the entire bottom wall 21 to provide the paperboard tray 20 with improved characteristics to withstand conveying the paperboard tray 20 through belts, holding the paperboard tray 20 at a fixed point, and using the paperboard tray 20 in an overwrapping process.

According to an embodiment of the present description, the paperboard reinforcement includes a spiral paperboard reinforcement at an end of the flange, wherein the spiral paperboard reinforcement is formed from the same coated paperboard that forms the bottom wall, the side wall, and the flange.

Figure 31:
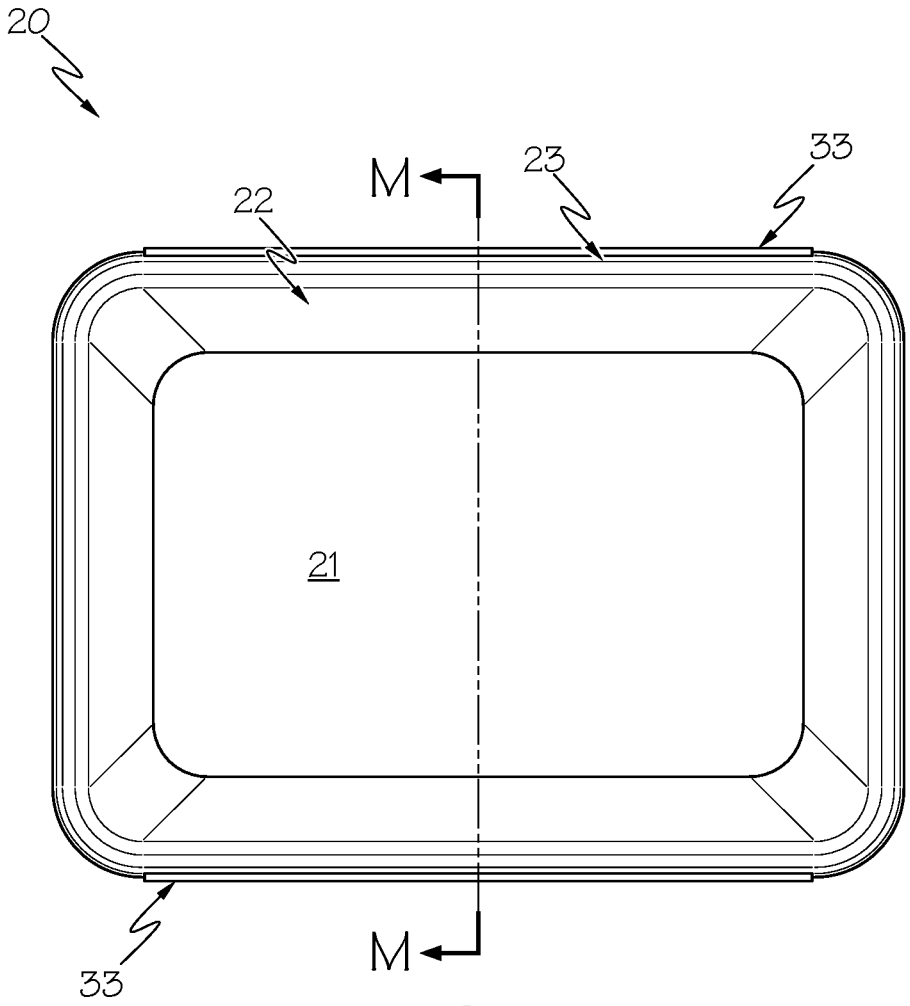
FIG. 31 is a bottom view of yet another paperboard tray, including one example of a spiral paperboard reinforcement.
Figure 32:
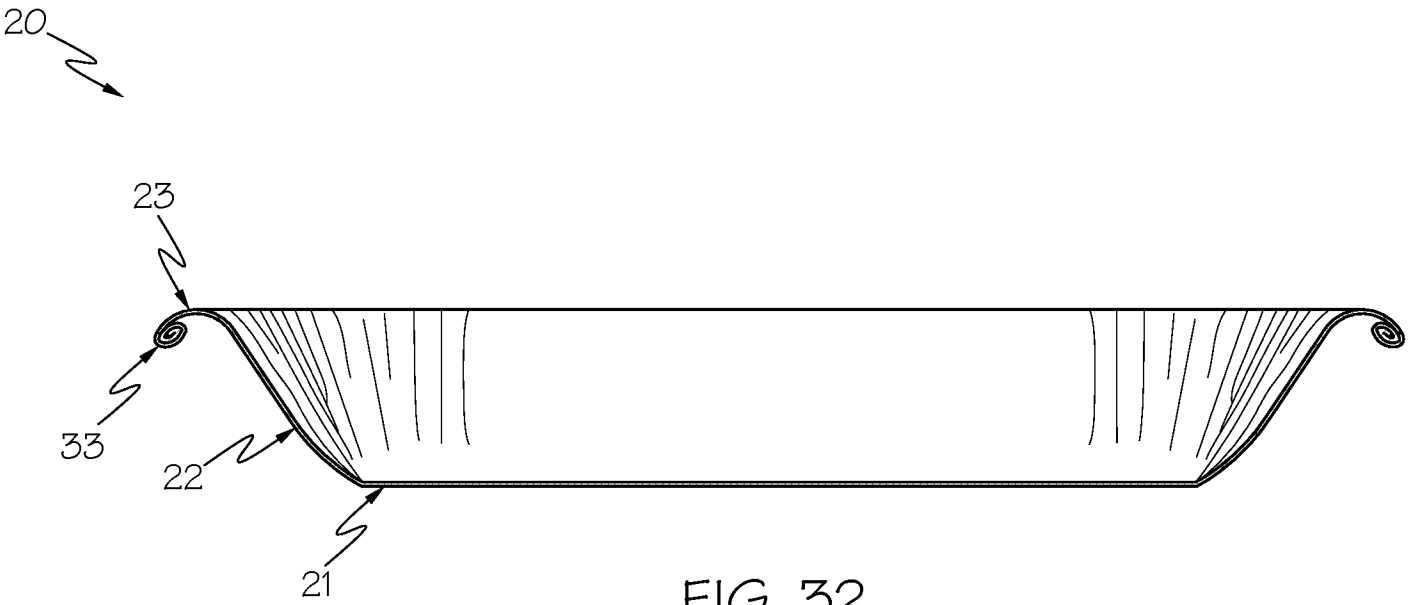
FIG. 32 is a side sectional view of the paperboard tray of FIG. 31 along section M-M.

FIGS. 31 and 32 illustrate an example of a spiral paperboard reinforcement 33. As shown, a rectangular paperboard tray 20 includes a coated paperboard 2 (FIG. 4) in the form of a bottom wall 21, a side wall 22 extending upwardly around the bottom wall 21, a curved flange 23 extending outwardly around the side wall 22, and the spiral paperboard reinforcement 33 at an end of the flange 23. The coated paperboard 2 includes a single-ply paperboard substrate 4 (FIG. 4) and a barrier coating 10 (FIG. 4) on the side of the single-ply paperboard substrate 4 that corresponds to an upper side of the bottom wall 21 and, optionally, a topcoat 12 (FIG. 4) on the side of the single-ply paperboard substrate 4 that corresponds to a lower side of the bottom wall 21. The spiral paperboard reinforcement 33 is positioned at the end of the curved flange 23. By positioning the spiral paperboard reinforcement 33 at the end of the curved flange 23, the spiral paperboard reinforcement 33 reinforces the flange 23 to provide the flange 23 of the paperboard tray 20 with improved characteristics to withstand conveying the paperboard tray 20 through belts, holding the paperboard tray 20 at a fixed point, and using the paperboard tray 20 in an overwrapping process.

In the example shown in FIGS. 31 and 32, spiral paperboard reinforcement 33 is positioned at the end of the flange 23 at both longitudinal ends of the rectangular paperboard tray 20. In an alternative, the spiral paperboard reinforcement 33 may be positioned at the end of the flange 23 at both latitudinal ends of the rectangular paperboard tray 20. In another alternative, the spiral paperboard reinforcement 33 may be positioned at the corners of the rectangular paperboard tray 20. In yet another alternative, the spiral paperboard reinforcement 33 may be positioned at the end of the flange 23 at both longitudinal ends and both latitudinal ends of the rectangular paperboard tray 20. In yet another alternative, the spiral paperboard reinforcement 33 may be positioned at the end of the flange 23 at either the longitudinal ends or both latitudinal ends of the rectangular paperboard tray 20 and the corners of the rectangular paperboard tray 20. In yet another alternative, the spiral paperboard reinforcement 33 may be positioned at the end of the flange 23 at both longitudinal ends, both latitudinal ends, and the corners of the rectangular paperboard tray 20. Thus, the spiral paperboard reinforcement 33 can stop short of the corners such as shown in FIG. 31 or the spiral paperboard reinforcement 33 can extend to the corners of the paperboard tray 20. Stopping the spiral paperboard reinforcement 33 short of the corners requires less material for the paperboard tray 20 and ensures better flexibility of the paperboard tray 20. Stopping the spiral paperboard reinforcement 33 short of the corners requires less material for the paperboard tray 20 and ensures better flexibility of the paperboard tray 20. Extending the spiral paperboard reinforcement 33 to the corners of the paperboard tray 20 enhances strength of the flange 23 and also increases the overall strength of the paperboard tray 20. The spiral paperboard reinforcement 33 reduce the likelihood of buckling along the flange 23 and reduce the likelihood of bending at the corners and twisting of the paperboard tray 20 at the corners when pressure is applied along the latitudinal or longitudinal ends of the paperboard tray 20. Thus, extending the spiral paperboard reinforcement 33 to the corners of the paperboard tray 20 decreases the likelihood of buckling along the latitudinal or longitudinal ends and decreases the likelihood of bending in the corners which could torque the tray. Other embodiments include that the paperboard tray 20 has a shape other than rectangular.

In the illustrated example, the spiral paperboard reinforcement 33 is preferably positioned at an underside of the flange 23. In an alternative, the spiral paperboard reinforcement 33 may be positioned atop the flange 23.

Figure 33:
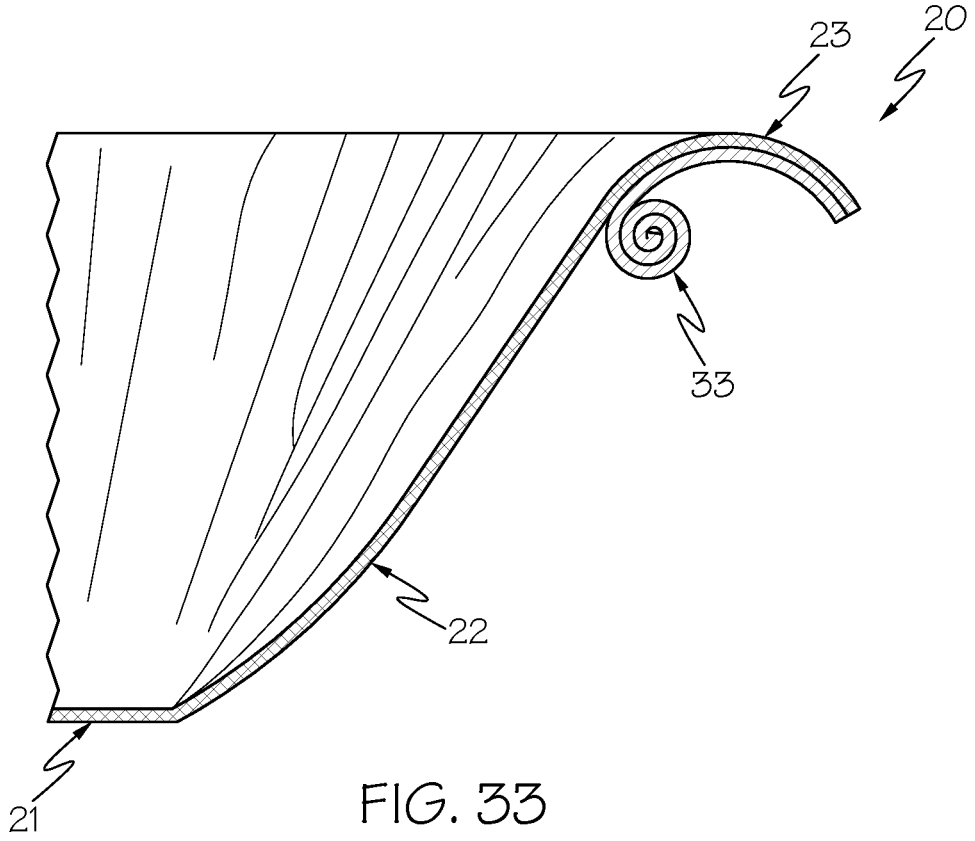
FIG. 33 is a side sectional view of yet another paperboard tray, including another example of a spiral paperboard reinforcement.
Figure 34:
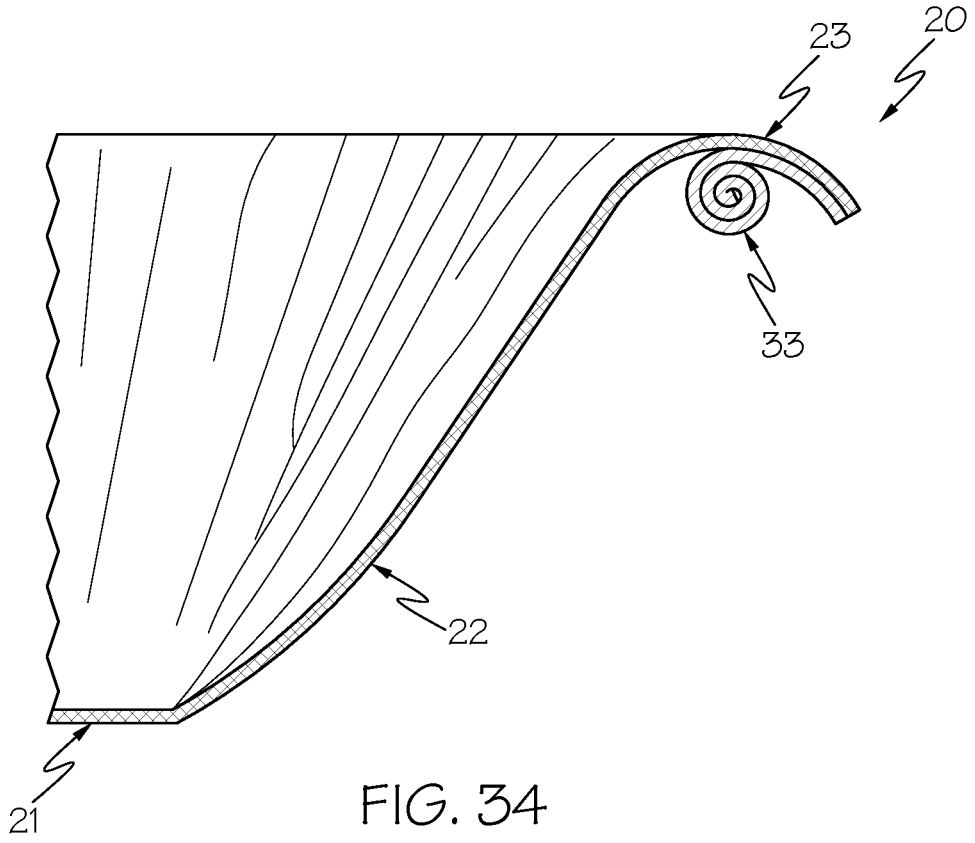
FIG. 34 is a side sectional view of yet another paperboard tray, including another example of a spiral paperboard reinforcement.
Figure 35:
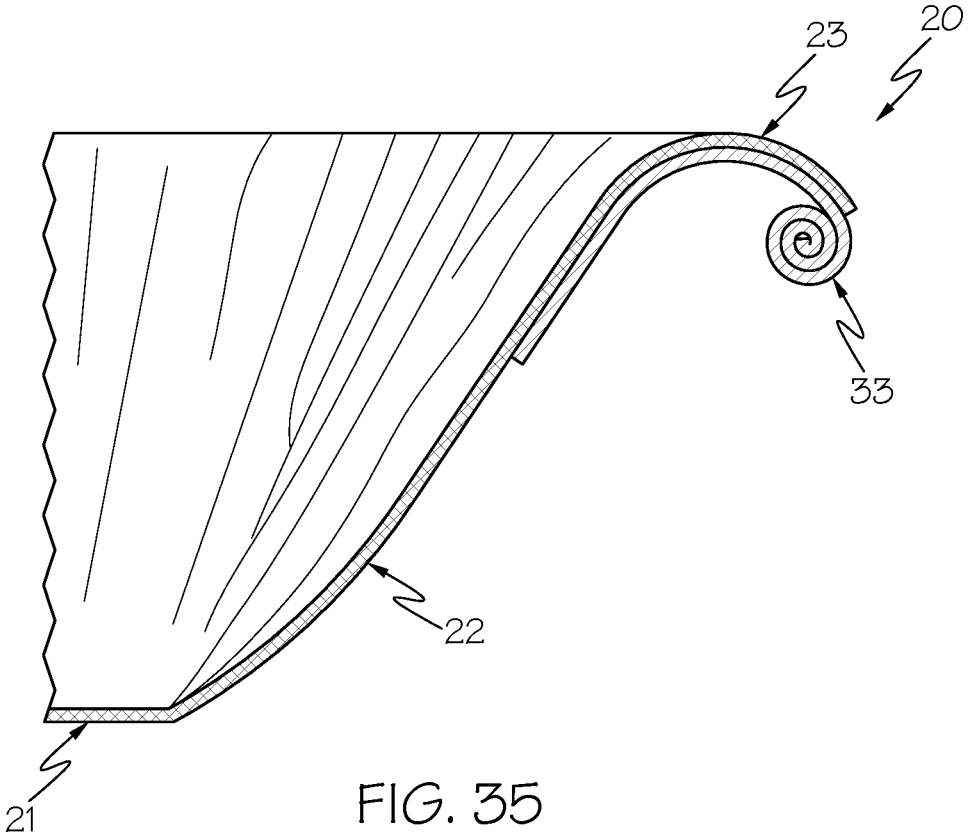
FIG. 35 is a side sectional view of yet another paperboard tray, including another example of a spiral paperboard reinforcement.
Figure 36:
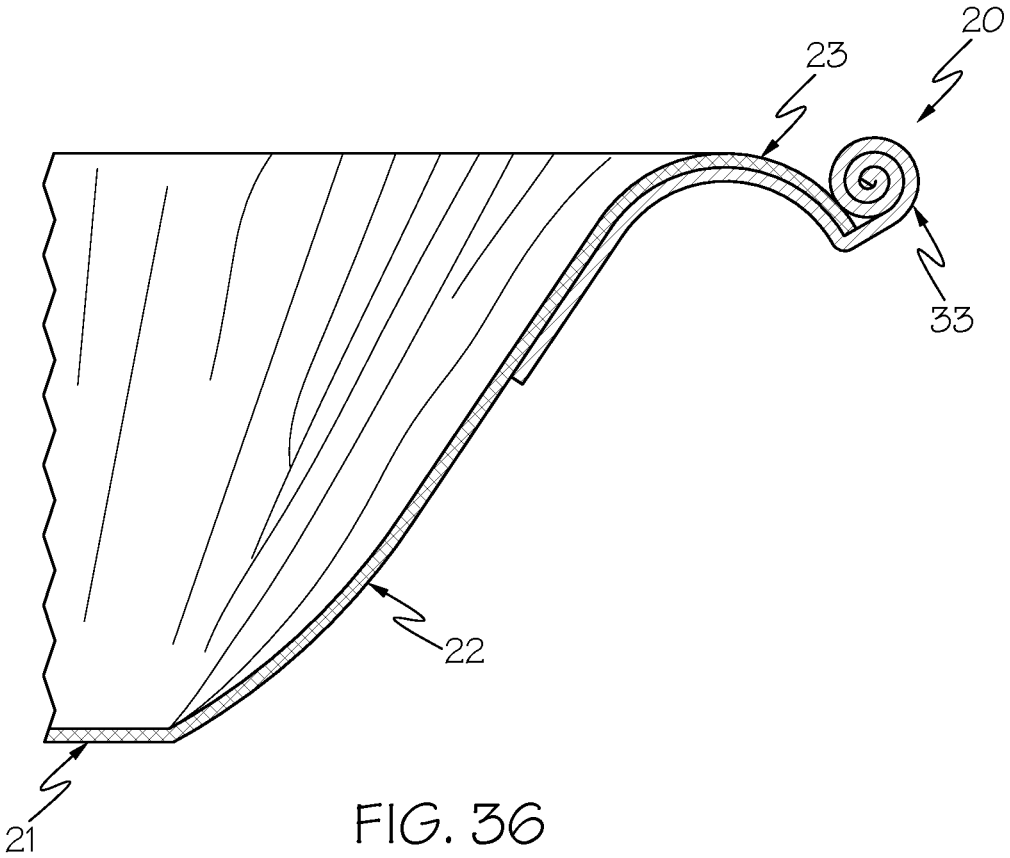
FIG. 36 is a side sectional view of yet another paperboard tray, including yet another example of a spiral paperboard reinforcement.

Referring to FIGS. 33-36, various alternative configurations of the spiral paperboard reinforcement 33 are also contemplated. As shown in FIG. 33, the example paperboard reinforcement shown in FIG. 6 can be modified to include a spiral paperboard reinforcement 33 disposed proximate the top of the side wall 22. As shown in FIG. 34, the example paperboard reinforcement shown in FIG. 6 can be modified to include a spiral paperboard reinforcement 33 disposed proximate the apex of the curved flange 23. As shown in FIG. 35, the example paperboard reinforcement shown in FIG. 24 can be modified to include a spiral paperboard reinforcement 33 disposed at the outward end of the reinforcement, with the spiral paperboard reinforcement 33 spiraling inward. As shown in FIG. 25, the example paperboard reinforcement shown in FIG. 24 can be modified to include a spiral paperboard reinforcement 33 disposed at the outward end of the reinforcement, with the spiral paperboard reinforcement 33 spiraling outward.

Figure 37:
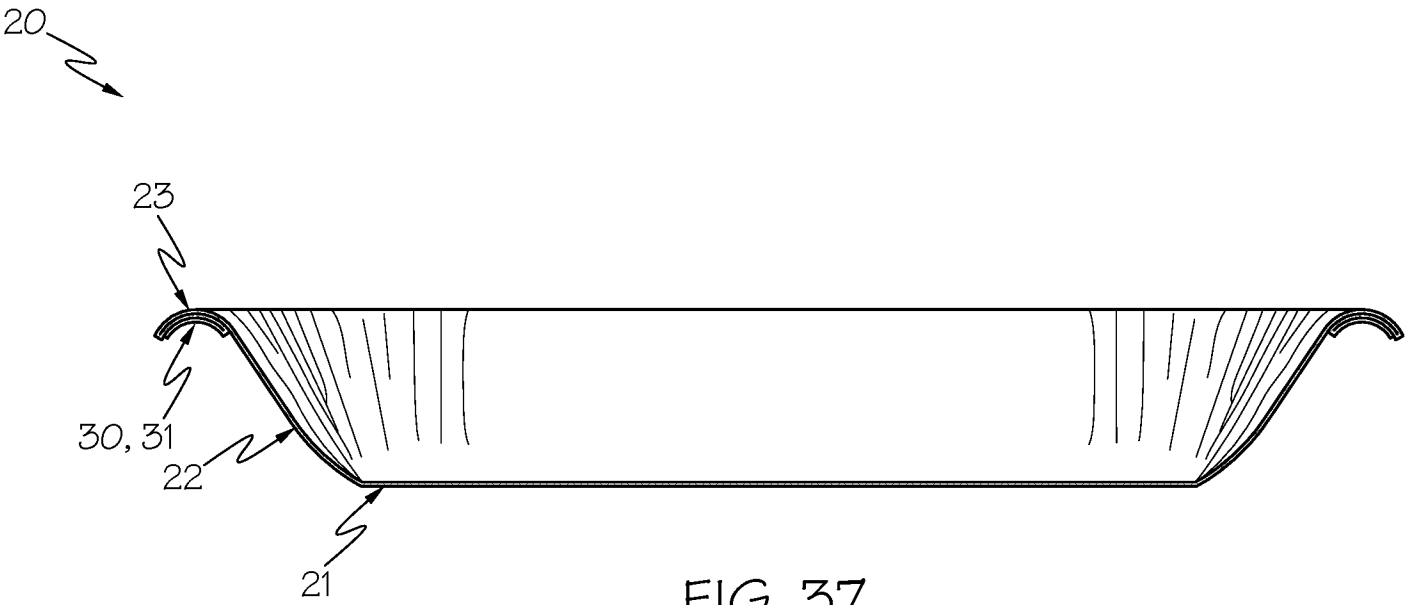
FIG. 37 is a side sectional view of yet another paperboard tray.
Figure 38:
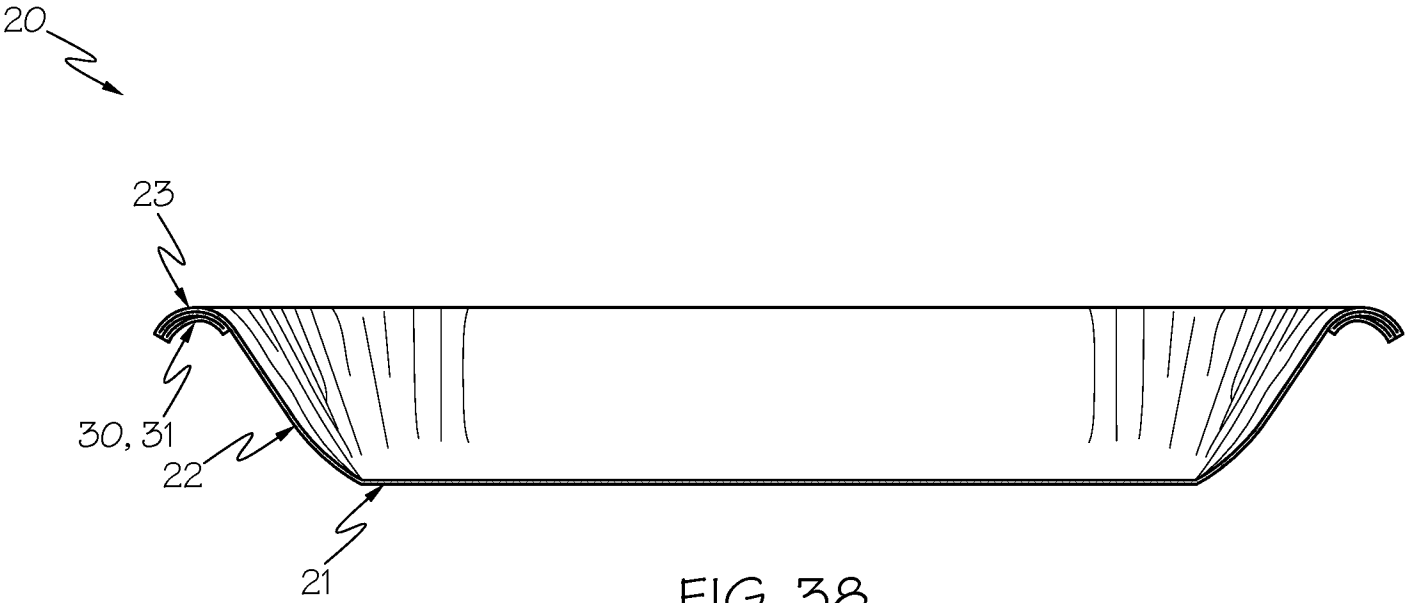
FIG. 38 is a side sectional view of yet another paperboard tray.

FIGS. 37 and 38 are side sectional views of yet additional paperboard trays according to the present description. As shown, the flange has a double reinforcement, i.e., two layers of paperboard reinforcement layers and one flange layer. In the of case of FIG. 37, there is a z-shaped fold where the exposed edge is oriented away from the tray. Alternatively, in the case of FIG. 38, there can be a second score and fold where the exposed edge is folded under and is hidden.

According to the present description, there is a method for manufacturing a reinforced paperboard tray. The method includes thermoforming a paperboard tray. The paperboard tray includes: a coated paperboard in the form of a bottom wall, a side wall extending upwardly around the bottom wall, and a curved flange extending outwardly around the side wall, the coated paperboard comprising a single-ply paperboard substrate having a first major side and a second major side, the first major side corresponding to an upper side of the bottom wall; and a barrier coating on the first major side of the single-ply paperboard substrate. The method further includes forming a paperboard reinforcement attached to a curved flange, the curved flange and the side wall, or the curved flange, the side wall, and a portion of the bottom wall. Forming the paperboard reinforcement attached to the curved flange occurs before thermoforming the paperboard tray, during thermoforming the paperboard tray, or after thermoforming the paperboard tray.

The method may include attaching a separate paperboard reinforcement to the curved flange. In one or more aspects, the paperboard reinforcement 30 may be in the form of strips of paperboard to add an additional layer in locations requiring increased rigidity. The strips may be flat, curved, or spiral. The strips can be applied through gluing, adhesive or heat-activated coatings. Glue can further provide rigidity by tacking and providing an extra support. Application of the strips can occur either before, during or post thermoforming. Methods of production before thermoforming include, for example, gluing strips before die cutting and scoring. Additionally, strips can be fed into thermoforming tooling used for forming the overall shape of the paperboard tray and combined with flange through heat and pressure by heat-activating coatings. Finally, strips can be applied post thermoforming by, for example, gluing and attaching strips with or without pressure.

In another aspect, the method may include attaching an integral paperboard reinforcement to the curved flange. Attaching an integral paperboard reinforcement to the curved flange may be performed by folding a portion of the coated paperboard and attaching the folded portion of the coated paperboard to curved flange. This may include scoring the coated paperboard along a score line prior to folding the scored portion of the coated paperboard along the score line, and then attaching the folded portion of the coated paperboard to curved flange.

In an aspect, attaching the paperboard reinforcement to the curved flange includes bonding the paperboard reinforcement to the curved flange. Bonding the paperboard reinforcement to the curved flange may include adhering the paperboard reinforcement to the curved flange. Bonding the paperboard reinforcement to the curved flange may include heat sealing the paperboard reinforcement to the curved flange.

In another aspect, the method includes cutting the coated paperboard and the paperboard reinforcement together while in a bonded state, such as by scoring the paperboard, folding the paperboard along a score line, bonding the folded paperboard, and then cutting the coated paperboard to form the shape of the reinforced paperboard tray. Alternatively, the cutting of the coated paperboard may be performed prior to bonding the paperboard reinforcement to the remainder of the paperboard tray. Thus, the method may include, for example, cutting a coated paperboard to form a paperboard blank, scoring the coated paperboard blank along a score line, folding the scored portion of the coated paperboard along the score line, and then attaching the folded portion of the coated paperboard to a curved flange portion of the paperboard tray.

In another aspect, the method includes thermoforming the coated paperboard, such as by thermoforming the paperboard reinforcement together with the remainder of the paperboard tray while in a bonded state to form the bottom wall, the side wall, and the reinforced curved flange.

By way of specific examples, the method of manufacturing the paperboard container may include the following exemplary preferred methods of manufacturing.

According to a first method of manufacturing, an integrally reinforced flange may be made by providing a coated paperboard sheet, folding the coated paperboard sheet while in sheet form, blanking the folded paperboard sheet, and then thermoforming the blanked paperboard sheet to result in the final form of the reinforcement paperboard tray. The attaching of the paperboard reinforcements to the remainder of the paperboard may be preferably performed by heat sealing during thermoforming.

According to a second method of manufacturing, an integrally reinforced flange may be made by providing a coated paperboard sheet, blanking the coated paperboard sheet to form the shape of a coated paperboard blank having wings that will be the paperboard reinforcements, then folding the wings to form the paperboard reinforcements, and then thermoforming to result in the final form of the reinforced paperboard tray. The attaching of the paperboard reinforcements to the remainder of the paperboard may be preferably performed by heat sealing during thermoforming.

According to a third method of manufacturing, an integrally reinforced flange may be made by providing a coated paperboard sheet, blanking the coated paperboard sheet to form the shape of a coated paperboard blank having wings, then thermoforming to result in the final form of the unreinforced paperboard tray having wings, and then folding the wings to form the paperboard reinforcements, and then attaching the wings to the remainder of the paperboard tray. The attaching of the paperboard reinforcements to the remainder of the paperboard may be preferably performed by heat sealing during hot pressing.

In another aspect, an air gap between an integral paperboard reinforcement and the bottom surface of the flange may be made by folding the coated paperboard, either before, during or after thermoforming, with a creasing feature in toolset that creates air pocket when pressing the flange.

In another one or more aspects, the paperboard tray may have stiffening members lateral to the flange (stiffeners) structures that can fold over during or post thermoforming. The stiffeners may come as a result of extensions from the flange(s). The stiffeners can either be folded or rolled to the original distance of an arced flange. Folds or rolls can be held in place by the following: lug to lock it in place, crimper, welder or glue. Glue can further provide rigidity by tacking and providing an extra support while stiffeners are folded over. Folds can be created and reinforced during thermoforming by a pre-step of folding and placing in the thermoforming tooling wherein it is reinforced to the inside portion of the flange by applying heat and pressure. Another method to create the fold as well as the roll would occur post-thermoforming. During thermoforming the stiffeners can extend outside the tooling to form the tray. After thermoforming the trays can stay in the tooling or be conveyed to a secondary step that folds or rolls the extensions to the underside of the flange(s). Folds/rolls can be held in place by an adhesive or glue as well as physical features such as slits that hold the stiffeners into place.

According to an aspect of the present description, a method for using the paperboard tray 20 includes positioning a food product within the paperboard tray 20 and wrapping a film over the product and the paperboard tray 20.

In an aspect, the food product may be a moist food product, such as meat, poultry, seafood, and produce, and the food product may be positioned with the paperboard tray 20 manually or by way of an automated process.

The step of wrapping the film over the product and the paperboard tray 20 may including a manual overwrapping process or an automatic overwrapping process using an overwrapping machine.

By way of example, an exemplary overwrapping machine may take a length of heat sealable film from a roll and fold it around a paperboard tray containing a product. The folded film may then be closed to itself by means of a heated sealing device. However, the overwrapping is not so limited. In a variation, overwrapping may include folding a film around the paperboard tray and lightly sealing the film to itself, such as by way of light heating or adhesive. In another variation, overwrapping may include folding a film around the paperboard tray and sealing the film to the paperboard tray, such as by way of heating or adhesive.

In one example, the film may be CRYOVAC® SES-340 oxygen permeable stretch-shrink poultry film. In another example, the film may be formed from a transparent wrapping material, such as CRYOVAC® D-940 Polyolefin Shrink Film Roll—60 gauge. In a variation, the film may be formed from a non-transparent wrapping material. In another variation, the transparent wrapping material or non-transparent wrapping material may be printable such as to permit printing of graphics and/or text on the film.

In an aspect, the present description enables providing a paperboard tray that is compostable. In another aspect, the present description enables providing a paperboard tray that is recyclable. In yet another aspect, the present description enables providing a paperboard tray that is printable or capable of being dyed.

The invention may be used, for example, in the following commercial areas: raw and cooked meat, seafood, vegetable substitutes for meat, produce, and consumables.

This present description may have at least the following advantages: increased rigidity of the tray; enables assisting in de-nesting trays by creating a separation between stacked trays; stiffeners may hide raw edge that may be susceptible to moisture pickup; and reduction of cost due to more efficient use of materials.

Although various embodiments of the disclosed reinforced paperboard tray, method for manufacturing the reinforced paperboard tray, and method for using the reinforced paperboard tray have been shown and described, modifications may occur to those skilled in the art upon reading the specification. The present application includes such modifications and is limited only by the scope of the claims.

What is claimed is:

1. A reinforced paperboard tray comprising:

a coated paperboard in a form of a bottom wall, a side wall extending upwardly around the bottom wall, and a curved flange extending outwardly around the side wall, the coated paperboard comprising a single-ply paperboard substrate having a first major side and a second major side, the first major side corresponding to an upper side of the bottom wall; and a barrier coating on the first major side of the single-ply paperboard substrate; and a paperboard reinforcement attached to the curved flange, wherein the paperboard reinforcement comprises an integral paperboard reinforcement attached to a bottom surface of the curved flange, wherein the integral paperboard reinforcement is attached to an outer surface of the side wall and to a portion of the bottom wall such that the integral paperboard reinforcement extends to a center of the bottom wall meeting or overlapping an opposing integral paperboard reinforcement, wherein the integral paperboard reinforcement is formed from the same coated paperboard that forms the bottom wall, the side wall, and the curved flange.

2. The reinforced paperboard tray of claim 1 wherein the paperboard reinforcement comprises a coated paperboard comprising a single-ply paperboard substrate having a first major side and a second major side; and a barrier coating on the first major side of the single-ply paperboard substrate.

3. The reinforced paperboard tray of claim 2 wherein the barrier coating for the paperboard reinforcement is a single coating layer positioned directly on the first major side of the single-ply paperboard substrate.

4. The reinforced paperboard tray of claim 2 wherein the coated paperboard for the paperboard reinforcement include a topcoat on the second major side of the coated paperboard.

5. The reinforced paperboard tray of claim 1 wherein a shape of the paperboard reinforcement at the bottom surface of the flange matches a shape of the flange.

6. The reinforced paperboard tray of claim 1 wherein the shape of the paperboard reinforcement at the bottom surface of the flange is different from the shape of the flange such there is an air gap between the paperboard reinforcement and the bottom surface of the flange.

7. The reinforced paperboard tray of claim 1, wherein the coated paperboard is substantially rectangular in shape and wherein the integral paperboard reinforcement is attached to the bottom surface of the curved flange at opposite sides of the rectangle.

8. The reinforced paperboard tray of claim 1, wherein the coated paperboard is substantially rectangular in shape, and wherein the integral paperboard reinforcement is attached to the bottom surface of the curved flange at corners of the rectangle.

9. The reinforced paperboard tray of claim 1, wherein the coated paperboard is substantially rectangular in shape, and wherein the integral paperboard reinforcement is attached to the bottom surface of the curved flange at opposite sides and at corners of the rectangle.

10. The reinforced paperboard tray of claim 1, wherein the coated paperboard is substantially rectangular in shape, and wherein the integral paperboard reinforcement is attached to the bottom surface of the curved flange at opposite sides around an entire periphery of the rectangle.

11. A reinforced paperboard tray comprising:

a coated paperboard in a form of a bottom wall, a side wall extending upwardly around the bottom wall, and a curved flange extending outwardly around the side wall, the coated paperboard comprising a single-ply paperboard substrate having a first major side and a second major side, the first major side corresponding to an upper side of the bottom wall; and a barrier coating on the first major side of the single-ply paperboard substrate; and a paperboard reinforcement attached to the curved flange, wherein the paperboard reinforcement comprises a separate paperboard reinforcement attached to a bottom surface of the curved flange, wherein the separate paperboard reinforcement is attached to an outer surface of the side wall and to a portion of the bottom wall such that the separate paperboard reinforcement extends to a center of the bottom wall meeting or overlapping an opposing separate paperboard reinforcement, wherein the separate paperboard reinforcement is formed from a separate piece of paperboard than the coated paperboard that forms the bottom wall, the side wall, and the curved flange.

12. A method for manufacturing a reinforced paperboard tray, the method comprising:

thermoforming a paperboard tray, the paperboard tray comprising: a coated paperboard in a form of a bottom wall, a side wall extending upwardly around the bottom wall, and a curved flange extending outwardly around the side wall, the coated paperboard comprising a single-ply paperboard substrate having a first major side and a second major side, the first major side corresponding to an upper side of the bottom wall; and a barrier coating on the first major side of the single-ply paperboard substrate; and forming a paperboard reinforcement attached to the curved flange, wherein the paperboard reinforcement comprises an integral paperboard reinforcement attached to a bottom surface of the curved flange, wherein the integral paperboard reinforcement is attached to an outer surface of the side wall and to a portion of the bottom wall such that the integral paperboard reinforcement extends to a center of the bottom wall meeting or overlapping an opposing integral paperboard reinforcement, wherein the integral paperboard reinforcement is formed from the same coated paperboard that forms the bottom wall, the side wall, and the curved flange.

13. The method of claim 12 wherein forming the paperboard reinforcement attached to the curved flange occurs before thermoforming the paperboard tray.

14. The method of claim 12 wherein forming the paperboard reinforcement attached to the curved flange occurs during thermoforming the paperboard tray.

15. The method of claim 12 wherein forming the paperboard reinforcement attached to the curved flange occurs after thermoforming the paperboard tray.

16. The method of claim 12 wherein forming the paperboard reinforcement comprises folding a portion of the coated paperboard and attaching the folded portion of the coated paperboard to curved flange.

17. The method of claim 12 further comprising scoring the coated paperboard along a score line, folding a portion of the coated paperboard along the score line, and attaching the folded portion of the coated paperboard to curved flange.

18. The method of claim 17 wherein bonding the paperboard reinforcement to the curved flange comprises one of adhering the paperboard reinforcement to the curved flange or heat sealing the paperboard reinforcement to the curved flange.

19. The method of claim 12 wherein attaching the paperboard reinforcement to the curved flange comprises bonding the paperboard reinforcement to the curved flange.

20. The method of claim 12 further comprising cutting the coated paperboard and the paperboard reinforcement together while in a bonded state.

21. A method for using a reinforced paperboard tray, the method comprising:

positioning a food product within a reinforced paperboard tray, the reinforced paperboard tray comprising:

a coated paperboard in a form of a bottom wall, a side wall extending upwardly around the bottom wall, and a curved flange extending outwardly around the side wall, the coated paperboard comprising a single-ply paperboard substrate having a first major side and a second major side, the first major side corresponding to an upper side of the bottom wall; and a barrier coating on the first major side of the single-ply paperboard substrate; and a paperboard reinforcement attached to the curved flange, wherein the paperboard reinforcement comprises an integral paperboard reinforcement attached to a bottom surface of the curved flange, wherein the integral paperboard reinforcement is attached to an outer surface of the side wall and to a portion of the bottom wall such that the integral paperboard reinforcement extends to a center of the bottom wall meeting or overlapping an opposing integral paperboard reinforcement, wherein the integral paperboard reinforcement is formed from the same coated paperboard that forms the bottom wall, the side wall, and the curved flange; and wrapping a film over the food product and the reinforced paperboard tray.

* * * * *